US008146322B2

(12) United States Patent
Karns

(10) Patent No.: US 8,146,322 B2
(45) Date of Patent: Apr. 3, 2012

(54) BUILDING STRUCTURE, METHOD OF MAKING, AND COMPONENTS

(75) Inventor: Jesse Karns, Mission Viejo, CA (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

(21) Appl. No.: 12/859,437

(22) Filed: Aug. 19, 2010

(65) Prior Publication Data

US 2011/0030305 A1 Feb. 10, 2011

Related U.S. Application Data

(63) Continuation-in-part of application No. 12/315,805, filed on Dec. 3, 2008, and a continuation-in-part of application No. 12/315,754, filed on Dec. 3, 2008, and a continuation-in-part of application No. 12/315,666, filed on Dec. 3, 2008, and a continuation-in-part of application No. 12/229,272, filed on Aug. 21, 2008.

(51) Int. Cl.
*E04B 1/19* (2006.01)
*E04B 1/38* (2006.01)

(52) U.S. Cl. ..... 52/655.1; 52/653.1; 52/657; 52/656.9; 52/831

(58) Field of Classification Search ..... 52/653.1, 52/657, 656.9, 236.3, 167.3, 655.1, 831, 52/837, 848; 403/186–189
See application file for complete search history.

(56) References Cited

U.S. PATENT DOCUMENTS 574,434 A * 1/1897 Keithley ..... 52/236.3
1,883,376 A 1/1932 Hilpert et al.
1,899,799 A * 2/1933 Edwards ..... 403/188
2,943,716 A 7/1960 Babcock
3,058,553 A * 10/1962 Hawes ..... 403/186
3,938,297 A * 2/1976 Sato et al. ..... 403/188
3,952,472 A 4/1976 Boehmig
3,963,099 A 6/1976 Skinner et al.
4,014,089 A 3/1977 Sato et al.
4,220,419 A * 9/1980 Hawes ..... 403/189
5,174,080 A 12/1992 Yoshimura et al.
5,497,591 A 3/1996 Nelson
5,660,017 A 8/1997 Houghton
5,802,169 A 9/1998 Frantz
6,009,674 A 1/2000 Root
6,059,482 A 5/2000 Beauvoir
6,138,427 A 10/2000 Houghton
6,219,989 B1 4/2001 Tumura
6,237,303 B1 5/2001 Allen
(Continued)

OTHER PUBLICATIONS

International Search Report regarding PCT/US2009/053758, mailed Mar. 30, 2010, 6 pages.

(Continued)

*Primary Examiner* — Eileen D Lillis
*Assistant Examiner* — Chi Nguyen
(74) *Attorney, Agent, or Firm* — Senniger Powers LLP

(57) ABSTRACT

A building framework includes plural column assemblies supporting plural beams supporting floors of the building, with the union of the column assemblies and beams forming beam-to-column (or beam-to-column-to-beam) joint connection assemblies according to this invention. The joint connection assemblies inventively include novel features which remarkably and surprisingly improve the distribution of strain and plastic deformation in the joint connection structure when subjected to extreme load challenges to the building structure (as may occur during earthquake, explosion, progressive collapse load conditions, or massive impact.

14 Claims, 15 Drawing Sheets

U.S. PATENT DOCUMENTS

| | | | |
|---|---|---|---|
| 6,516,583 | B1 | 2/2003 | Houghton |
| 6,591,573 | B2 | 7/2003 | Houghton |
| 6,634,153 | B1 | 10/2003 | Peterson |
| 6,802,169 | B2 | 10/2004 | Simmons |
| 7,178,296 | B2 | 2/2007 | Houghton |
| 7,637,076 | B2 | 12/2009 | Vaughn |
| 2002/0124520 | A1 | 9/2002 | Bock et al. |
| 2003/0208985 | A1 | 11/2003 | Allen et al. |
| 2010/0043348 | A1 | 2/2010 | Houghton et al. |

OTHER PUBLICATIONS

International Search Report regarding PCT/US2009/053736, dated Dec. 17, 2009 4 pages.

Office action issued Jun. 23, 2011 in related U.S. Appl. No. 12/315,805; 13 pgs.

Response filed Jul. 7, 2011 to Office Action dated Apr. 25, 2011 from related U.S. Appl. No. 12/229,272; 17 pgs.

Office action issued Aug. 2, 2011 in related U.S. Appl. No. 12/315,754; 11 pgs.

Office action dated Oct. 21, 2010 from U.S. Appl. No. 12/229,272, 11 pages.

Response filed Jan. 21, 2011 to Office action issued Oct. 21, 2010 in U.S. Appl. No. 12/229,272, 18 pages.

Office action dated Apr. 25, 2011 from U.S. Appl. No. 12/229,272, 12 pages.

Office action dated Apr. 29, 2011 from U.S. Appl. No. 12/315,666, 14 pages.

Office action dated Nov. 29, 2010 from U.S. Appl. No. 12/315,754, 14 pages.

Response filed Mar. 28, 2011 to Office action issued Nov. 29, 2010 in U.S. Appl. No. 12/315,754, 17 pages.

Office action dated Nov. 29, 2010 from U.S. Appl. No. 12/315,805, 14 pages.

Response filed Mar. 28, 2011 to Office action issued Nov. 29, 2010 in U.S. Appl. No. 12/315,805, 18 pgs.

PCT International Search Report and Written Opinion regarding PCT/US2011/048441 dated Nov. 25, 2011, 12 pgs.

* cited by examiner

BUILDING STRUCTURE, METHOD OF MAKING, AND COMPONENTS

CROSS REFERENCE TO RELATED APPLICATION

This application is a Continuation-in-Part of U.S. application Ser. No. 12/229,272, filed 21 Aug. 2008, and of U.S. application Ser. Nos. 12/315,666; 12/315,754; and 12/315,805, each filed 3 Dec. 2008, respectively; and incorporates by reference the disclosure of those earlier applications.

BACKGROUND OF THE INVENTION

Buildings, towers and similarly heavy structures commonly are built on and around a steel frame work. This steel framework generally includes substantially vertical columns supporting substantially horizontal beams, with the beams supporting building floors. A primary structural consideration of such a steel framework is the plural joint connections of the beams to the columns and to one another. An improved structural joint connection is disclosed in U.S. Pat. No. 5,660,017 (hereinafter, "the '017 patent"). However, advanced stress analysis techniques and a study of building collapse mechanisms following seismic events, and also in view of explosive blast events (i.e., terrorist bombings) and subsequent progressive collapse load conditions have resulted in further improvements.

More particularly, during the last decade there have been concerns about how to improve the beam-to-column, and beam-to-beam joint connections of a steel frame building so they will better withstand seismic events (i.e., earthquake), explosions, blasts, massive impacts, and the like as well as other related extraordinary load phenomena. Of particular concern is the prevention of progressive collapse of a building if there are one or more column failures due to the effects of a terrorist bomb blast, vehicular and/or debris impact, earthquake, structural fire, or any other impact and/or heat-induced damaging condition.

Failures in a column, beams, and/or beam-to-column joint connection structures, and beam-to-beam joint connection structures, due to explosions, severe impact and/or sustained fire, have led to progressive collapse of entire buildings. Solutions for this problem have been sought. For example, following the 1994, Northridge, Calif. earthquake, and in addition to the invention set forth in U.S. Pat. No. 5,660,017, a number of other beam-to-column joint connection alternatives to resist failures in beams, columns and/or their associated beam-to-column joint connection structures were suggested or adopted for use in steel frame constructions for improved seismic performance. For example, the reduced beam section (RBS), or "dog bone" joint connection has been proposed, in which the beam flanges are significantly narrowed near the joint connection. This alternative design reduces the plastic moment capacity of the beam allowing inelastic hinge formation in the beam to occur at the reduced section of the beam. This inelastic hinge connection is thought to relieve some of the stress in the welded joint connection between the beam flange and the column flange. An example is seen in U.S. Pat. No. 5,595,040, for Beam-to-Column Connection, which illustrates such "dog bone" connections. But, because the plastic moment capacity of the beam is reduced due to the significant narrowing of the beam flanges, the moment capacity which can be sustained by the beam is also significantly reduced.

Another alternative is illustrated by U.S. Pat. No. 6,237,303, in which slots and/or holes are provided in the web of the beam, in the vicinity of the welded beam-to-column joint connection, in order to provide improved stress and strain distribution in the vicinity of the welded beam flange-to-column flange joint connection. Other post-Northridge joint connections are also identified in FEMA 350-Recommended Seismic Design Criteria for New Steel Moment Frame Building, published by the Federal Emergency Management Agency in 2000. All such post-Northridge joint connections have reportedly demonstrated their ability to achieve significant inelastic rotational capacity to survive a severe earthquake.

However, one important consideration to be noted in contrast to the present invention is that none of these alternative beam-to-column joint connection structures (other than the '017 patent noted above) provide independent beam-to-beam structural continuity across a compromised column. Accordingly, such joint connection structures can provide only a limited amount of post-blast residual gravity load-carrying capacity due to their inability to resist the gravity load demand of simultaneous moment and axial tension, which load interaction is the result of the formation of a "double-span" condition caused by two beams being connected to a common column which is then suddenly or violently removed or otherwise is severely compromised due to explosion, blast, impact or other events. However, in this invention, with the use of gusset plates (or side plates) as taught in the '017 patent, and with proper design, such beam-to-beam continuity across the location of a removed column will be capable of independently carrying gravity loads under such a double-span condition. Additionally, none of these alternatives, except the gusset plates used as taught in the '017 patent, provide any significant torsion capacity or significant resistance to lateral bending to resist direct explosive air blast impingement and severe impact loads. Torsion demands for such joint connection structures are created because while the top flange of a beam is typically rigidly attached to the floor system of a building against relative lateral movement, the bottom flange of that beam is free to twist when subjected to, for example, direct lateral blast impingement loads caused by a terrorist attack. A beam-to-column joint connection structure according to this invention will sustain such double-span conditions as well as demands from severe torsion loads; while also providing advantages in surviving rotational movements, as will be further explained.

That is, a significant consideration is the inelastic durability or life expectancy of a beam, and its beam-to-column joint connection in a steel frame when subjected to cyclic rotational demands of ever increasing magnitude. That is, when a steel frame beam and its beam-to-column joint connection are subjected to cyclic swaying of the building because of earthquake, or perhaps because of impact, the beam experiences cyclic rotational movements relative to the column it connects to, which rotations are typically measured in percentages of a radian. That is, 1 radian equals $360°/2\pi$, or approximately 36.5°.

SUMMARY OF INVENTION

In one aspect of the present invention, a joint connection structure comprises a column a beam supported by the column. A pair of elongate horizontal cover plates arranged in a vertically spaced pair sandwich therebetween and unite with an end part of the beam proximate to the column. The pair of cover plates also connect with said column so as to transfer force and strain between said column and said beam. At least one of said pair of cover plates at a distal portion thereof spaced from said column defines a yieldable portion adapted to communicate and distribute strain over a volume of said beam. Whereby, during an extreme event effecting cyclic rotational movements of said joint connection structure the at least one cover plate is plastically deformed progressively within said distal portion thereof with successive cycles of rotational movement, and the beam is also plastically deformed progressively in said volume thereof.

In another aspect of the present invention, a full-length beam assembly for use in a joint connection structure, the full-length beam assembly comprising a length of I-section or H-section beam stock. At least one end portion of the section of beam stock carries a pair of elongate horizontal cover plates arranged in a vertically spaced pair, sandwiching therebetween and united with said end portion of said beam stock. At least one of said pair of cover plates at a distal portion thereof spaced from the respective end of said length of beam stock defines a yieldable portion adapted to communicate and distribute strain to the beam over an extended length portion thereof so that during an extreme event effecting cyclic rotational movements of the joint connection structure said at least one cover plate is plastically deformed progressively within said distal portion thereof with successive cycles of rotational movement, and the beam is also plastically deformed progressively adjacent to said distal portion of said at least one cover plate. The yieldable portion comprises a yieldable tongue portion defined by the at least one cover plate and extending along a length dimension of said beam at the distal portion of the at least one cover plate.

In still another aspect of the present invention, a steel frame building welded joint connection structure for absorbing strain during an extreme event which effects plural rotational displacement cycles of said joint connection structure thus preserving building integrity and human life. The welded joint connection structure comprises a column; and a beam supported by the column. A spaced apart parallel pair of vertically and horizontally extending elongate gusset plates sandwich between them the column and unite therewith. The pair of gusset plates each have an extending end portion sandwiching therebetween and united with an end part of the beam. A pair of elongate horizontal cover plates arranged in a vertically spaced pair sandwich therebetween and unite with an end part of the beam. The cover plates also unite with and connect the gusset plates so that the pair of cover plates form a connection between the beam and the pair of gusset plates. At least one of the pair of cover plates at a distal portion thereof spaced from said column defines means for communicating strain into said beam and for progressively distributing strain into said beam over an extended length portion thereof with successive rotational cycles and increasing straining of the beam and at least one cover plate. Whereby, during an extreme event said cover plate is plastically deformed progressively with successive rotational cycles, and said beam is also plastically deformed progressively in said extended length portion thereof In a further aspect of the present invention, a method of increasing the volume and length of steel at an end part of a beam throughout which plastic strain in a steel frame building is distributed, so that said beam absorbs increased strain during an extreme event. The extreme event effects plural rotational displacement cycles of joint connection structures of the building. The method preserves building integrity and human life. The method comprises providing a column and a beam supported by the column. On the column, a spaced apart parallel pair of vertically and horizontally extending elongate gusset plates sandwiching said column therebetween and united therewith are provided. The pair of gusset plates each has an extending end portion sandwiching an end part of said beam therebetween and united with said beam. A pair of elongate horizontal cover plates arranged in a vertically spaced pair sandwiching therebetween and united with an end part of said beam are provided. The cover plates unite with and connect said pair of gusset plates so that said pair of cover plates form the connection between said beam and said pair of gusset plates. At least one of said pair of cover plates at a distal portion thereof spaced from said column has a yieldable tongue defined in it for communicating strain into the beam and for progressively distributing strain into the beam over an extended length portion thereof with successive rotational cycles and increasing straining of the beam. Whereby, during an extreme event the cover plate yieldable tongue is plastically deformed progressively with successive rotational cycles of said joint connection structure, and the beam is also plastically deformed progressively distal of the pair of gusset plates In still a further aspect of the present invention, a method of making a building framework, said method comprising steps of providing a pair of spaced apart vertical column assemblies; and configuring each of the pair of vertical column assemblies to include a vertically elongate column member defining a horizontal dimension. Each of the vertical column assemblies is additionally provided with a respective pair of horizontally spaced vertically and horizontally extending gusset plate members spanning the horizontal dimension of the respective one of the column members and projecting generally horizontally toward the other column assembly of the pair. A full-length beam assembly is provided to be disposed at opposite end portions thereof at least partially between the pair of projecting gusset plates of the pair of column assemblies, providing for said full-length beam assembly to include a beam member defining an end gap with each column member of said pair of column assemblies. The full-length beam assembly includes at one end thereof a pair of opposite cover plates each extending along an end portion of the beam member at each opposite ends of said full-length beam assembly and sandwiching the beam member. The pair of cover plates are disposed between a respective pair of projecting gusset plates of a respective one of the pair of column assemblies. The pair of cover plates are welded to the gusset plates to form a beam-to-column joint assembly. Each one of the pair of cover plates has defined in it a respective axially extending yieldable tongue portion extending distally along a part of said beam and uniting therewith by a weld which is at least partially frangible.

Further objects, features, capabilities and applications of the inventions herein will be apparent to those skilled in the pertinent arts, from a consideration of the appended drawing Figures and description of particularly preferred embodiments of the invention.

BRIEF DESCRIPTION OF THE DRAWING FIGURES

FIGS. 1A, and 1B each diagrammatically provide an elevation view of a multi-story building framework; with FIG. 1A depicting the building in quiet repose, and FIG. 1B depicting the displaced building's story-to-story drift (i.e., inter-story drift) and associated rotation of it's beam-to-column joint connections during an earthquake event when subjected to lateral ground shift;

Figure 2:
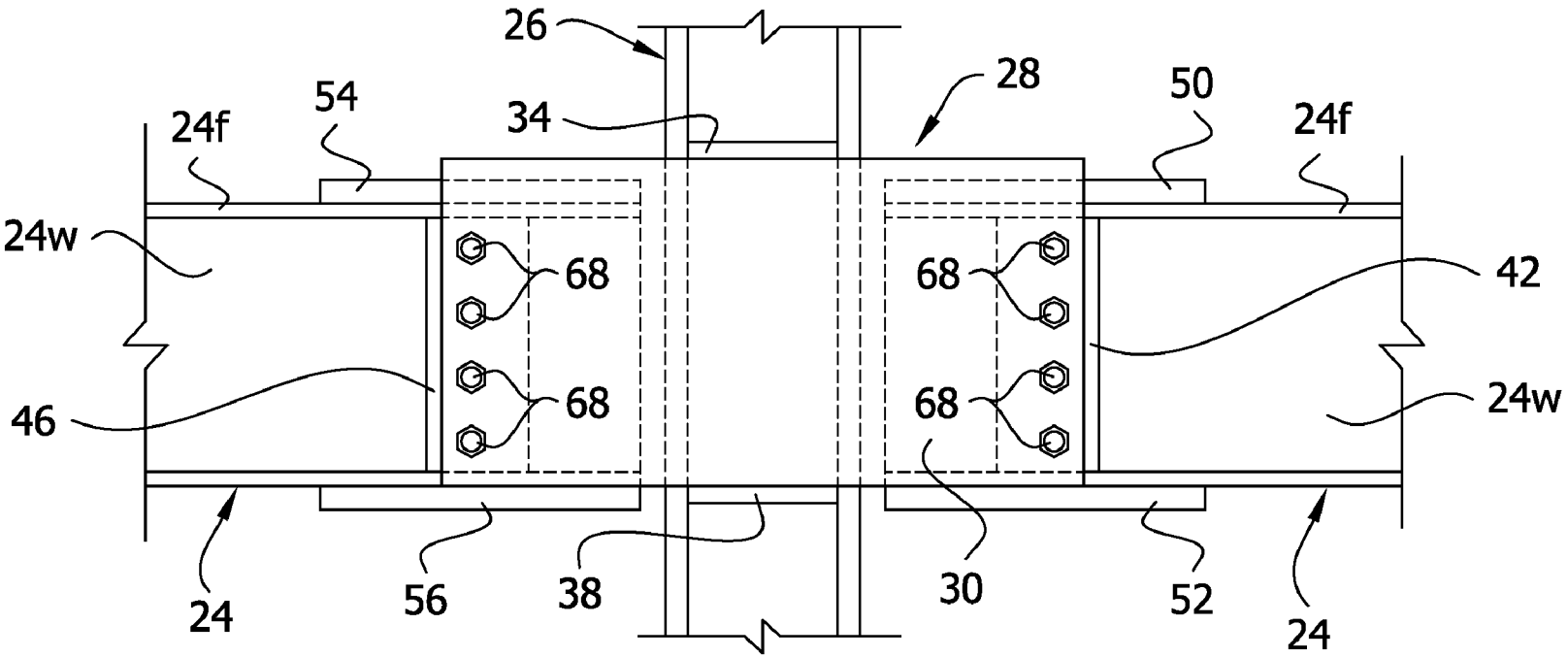
FIG. 2 is a fragmentary, side elevation view of the building framework seen in FIGS. 1A and 1B showing a beam-to-column joint connection structure.
Figure 3:
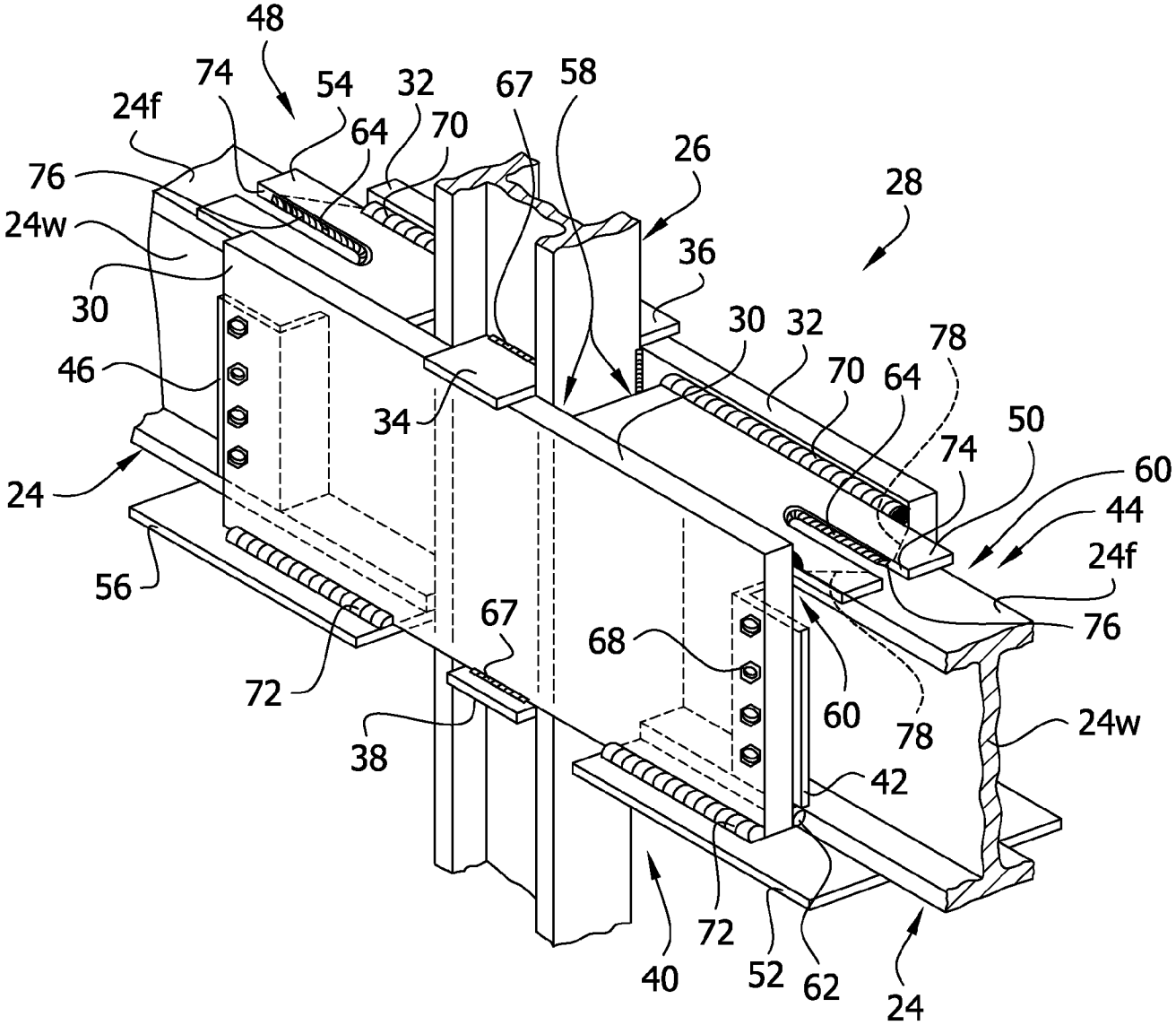
FIG. 3 is a perspective view of the beam-to-column joint connection structure seen in FIG. 2.
Figure 4A:
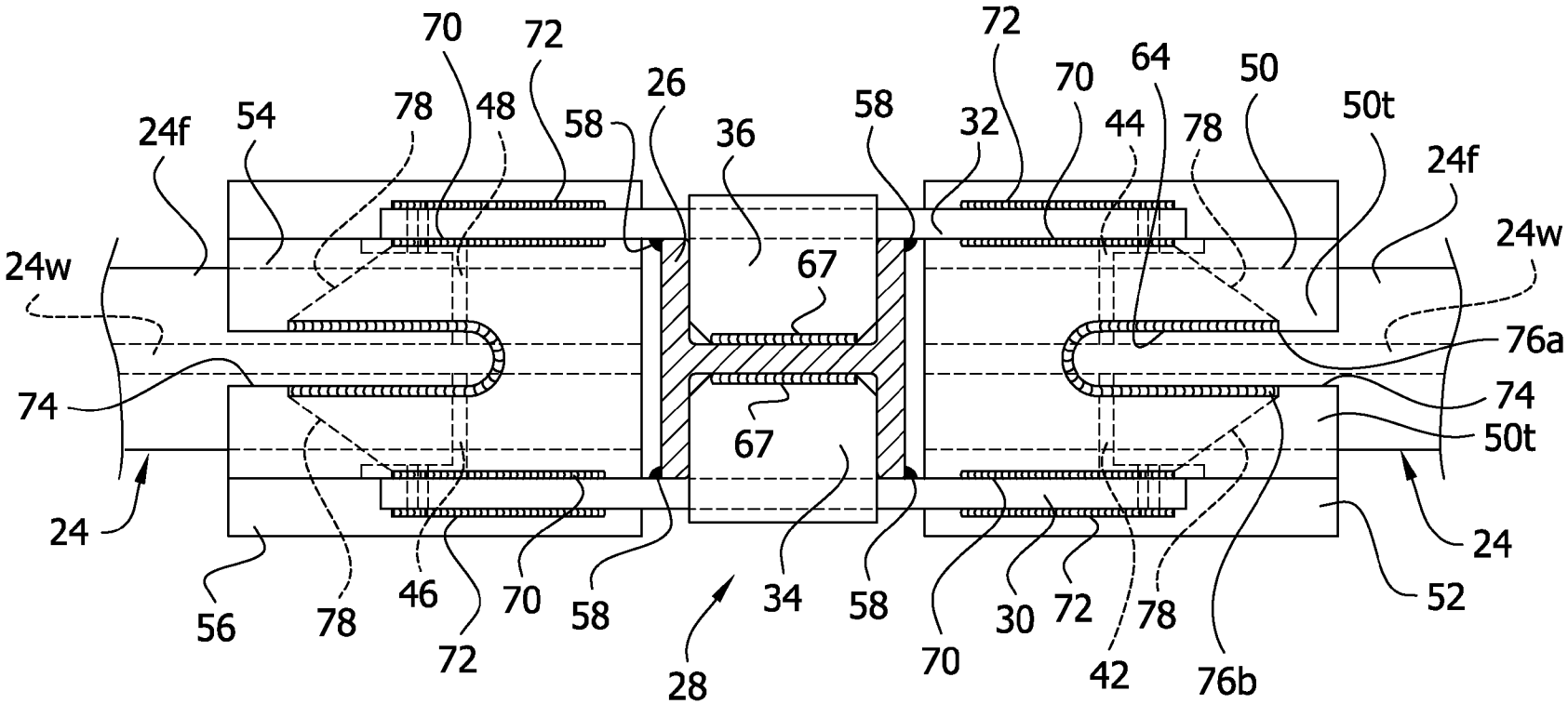
Figure 4B:
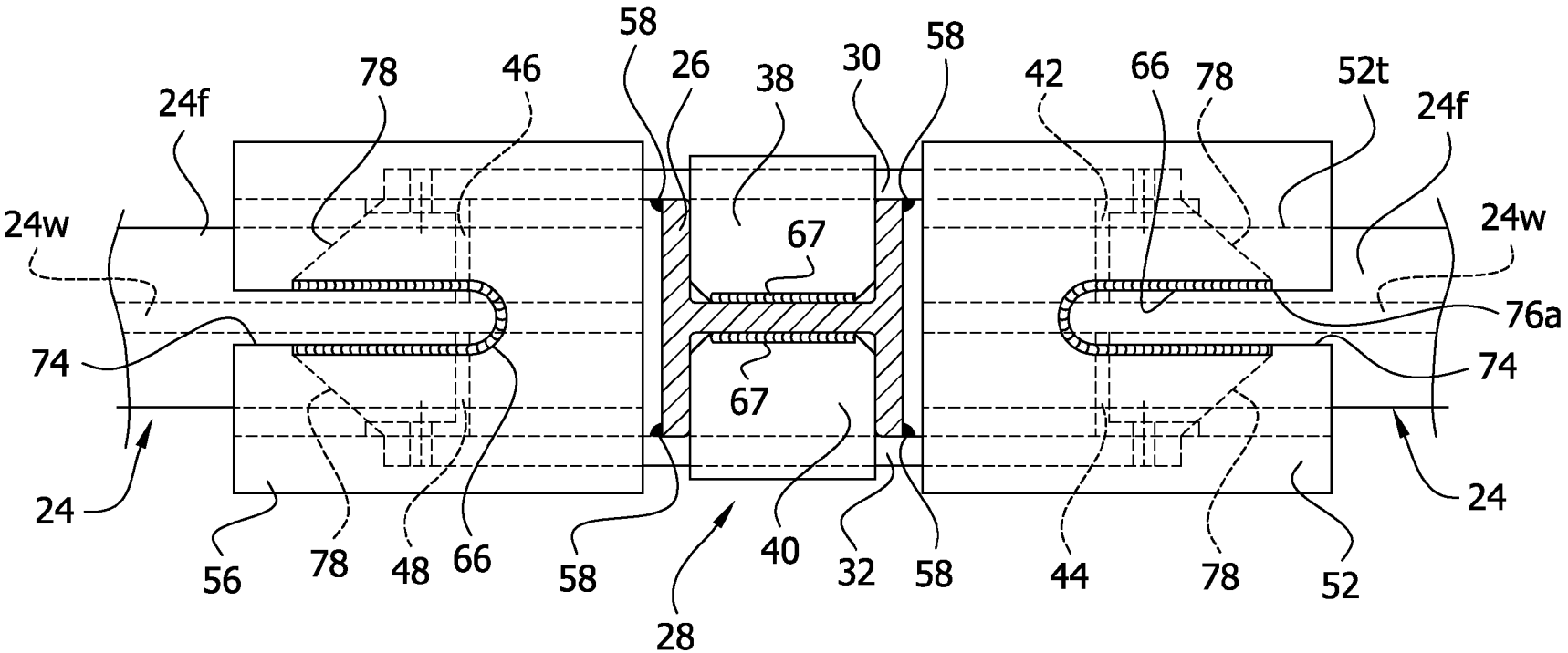
Figure 4C:
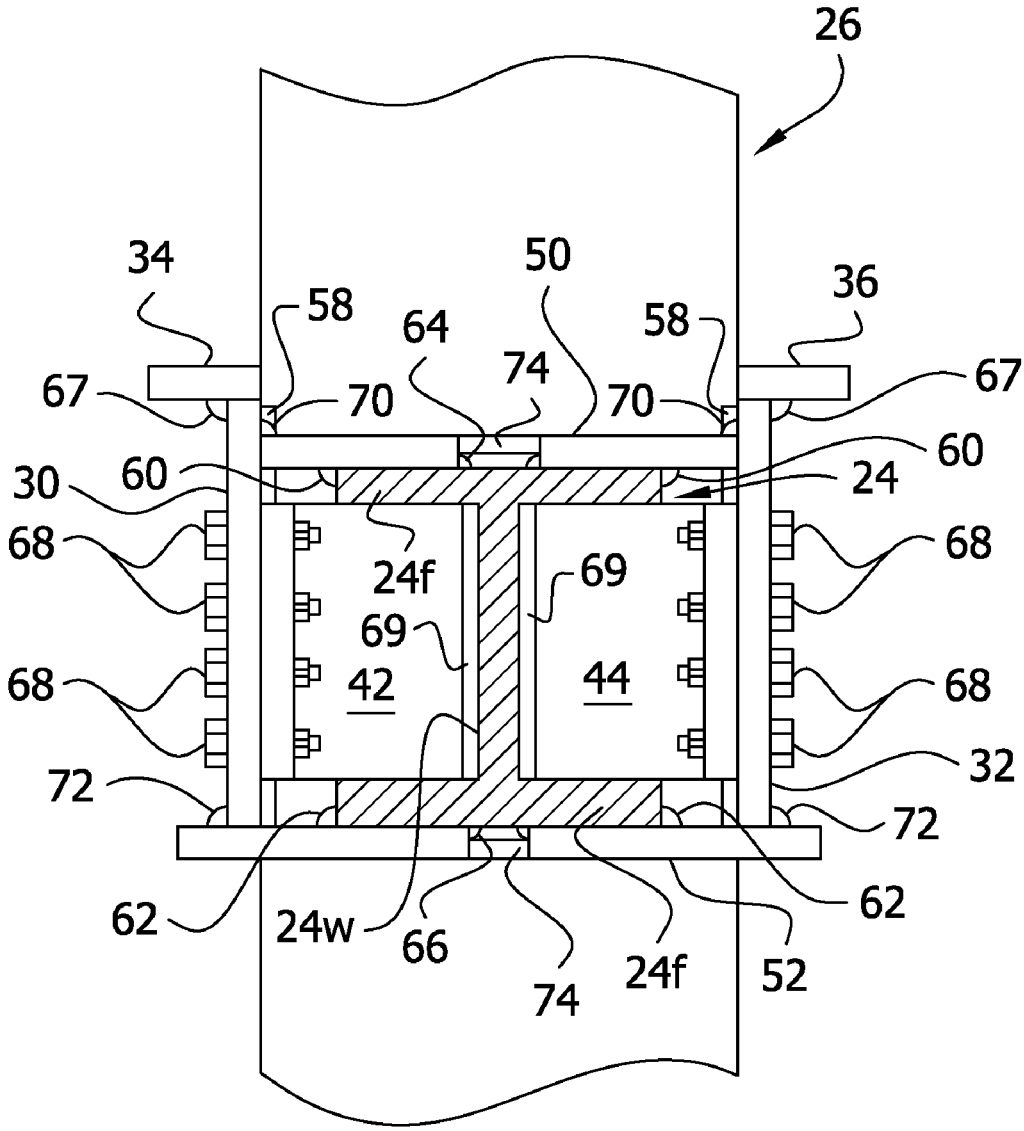
Figure 5A:
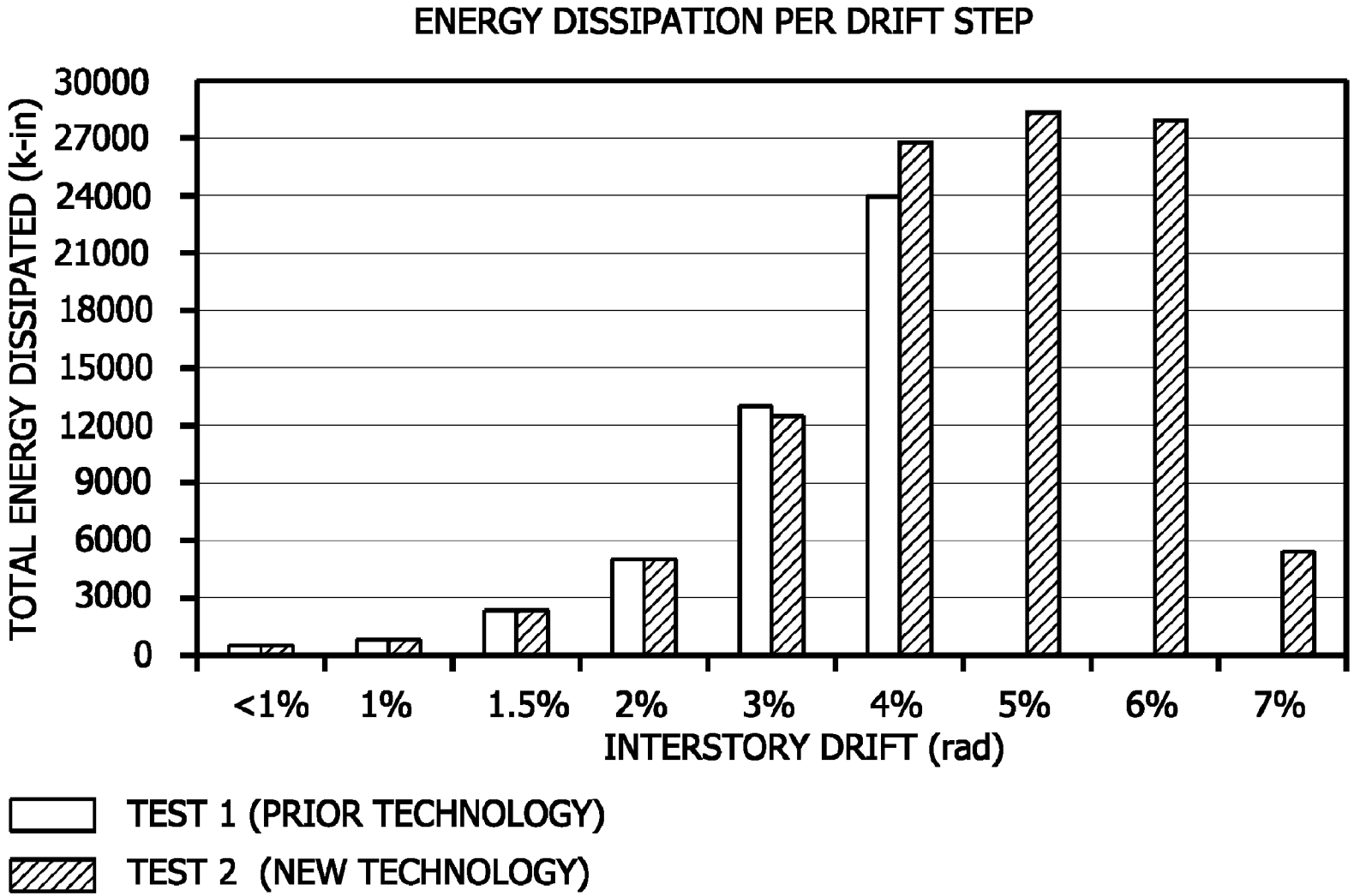
Figure 5B:
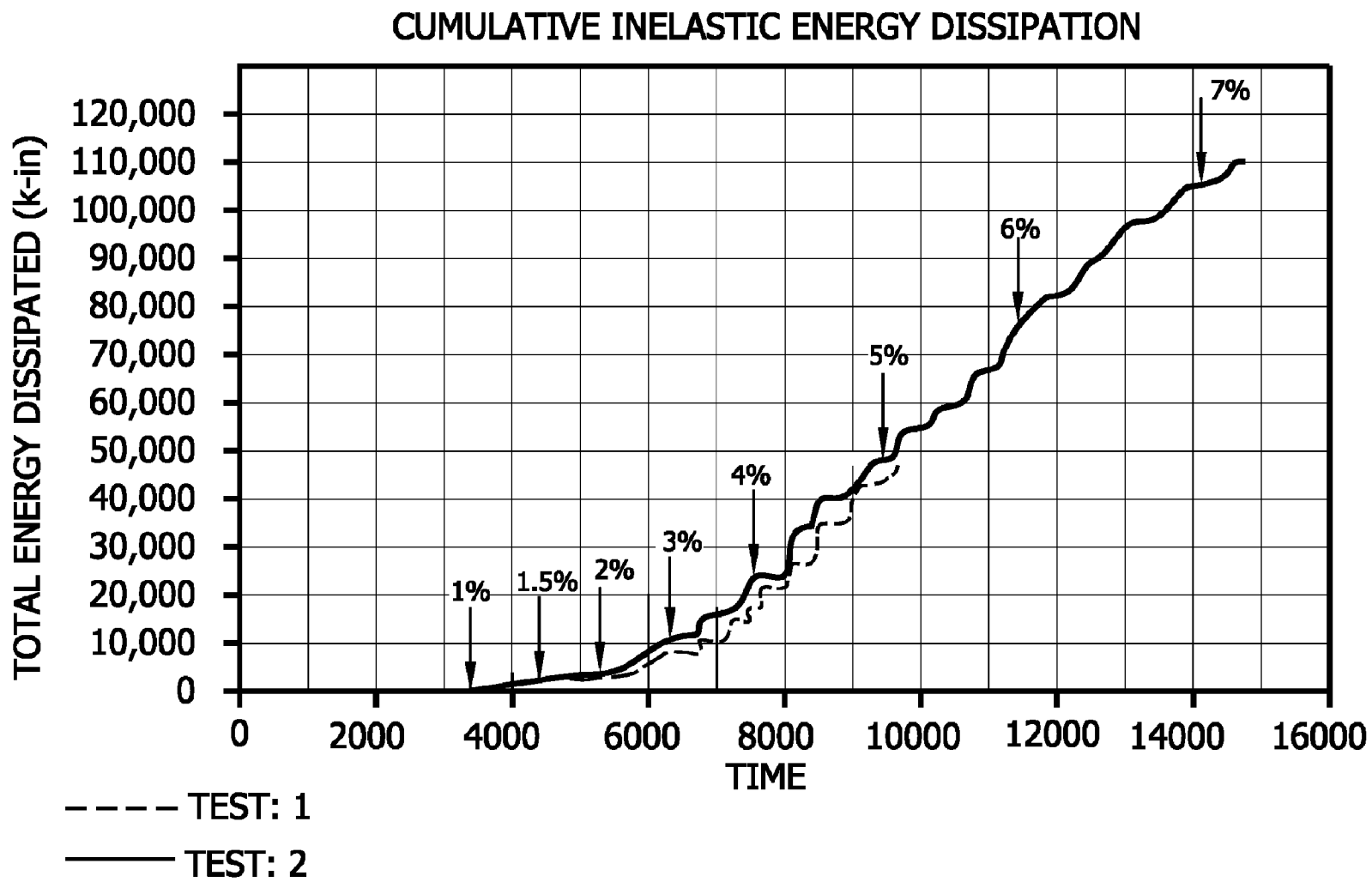
Figure 6A:
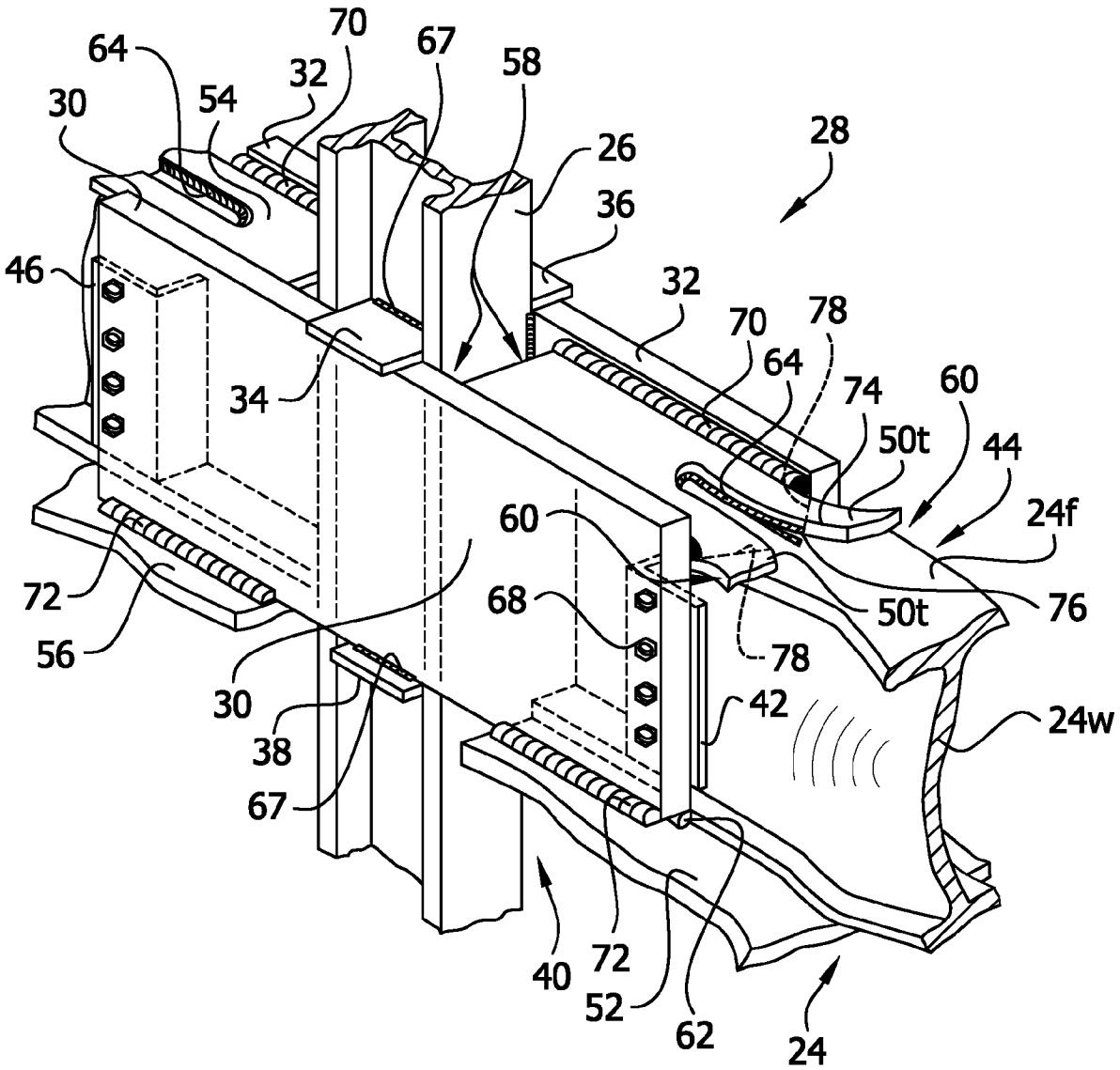
Figure 6B:
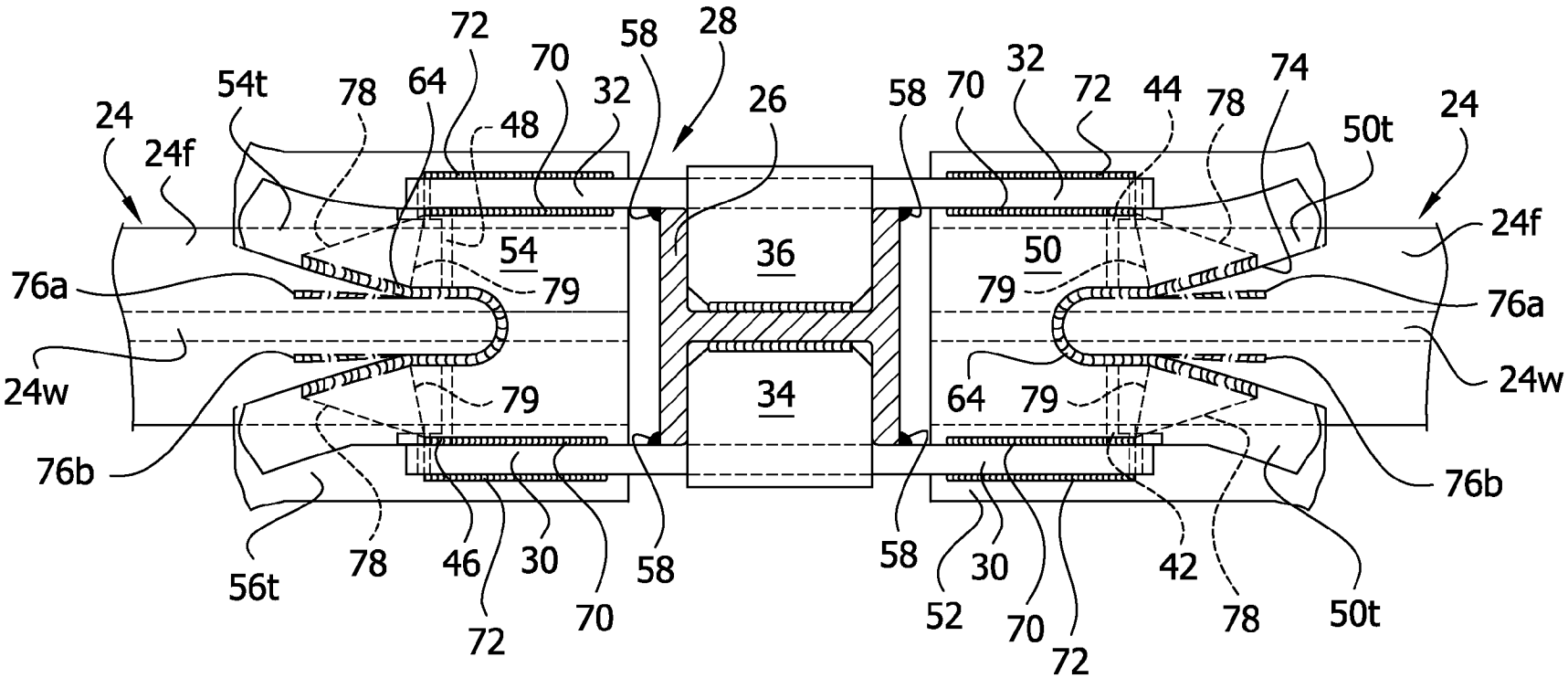
Figure 7A:
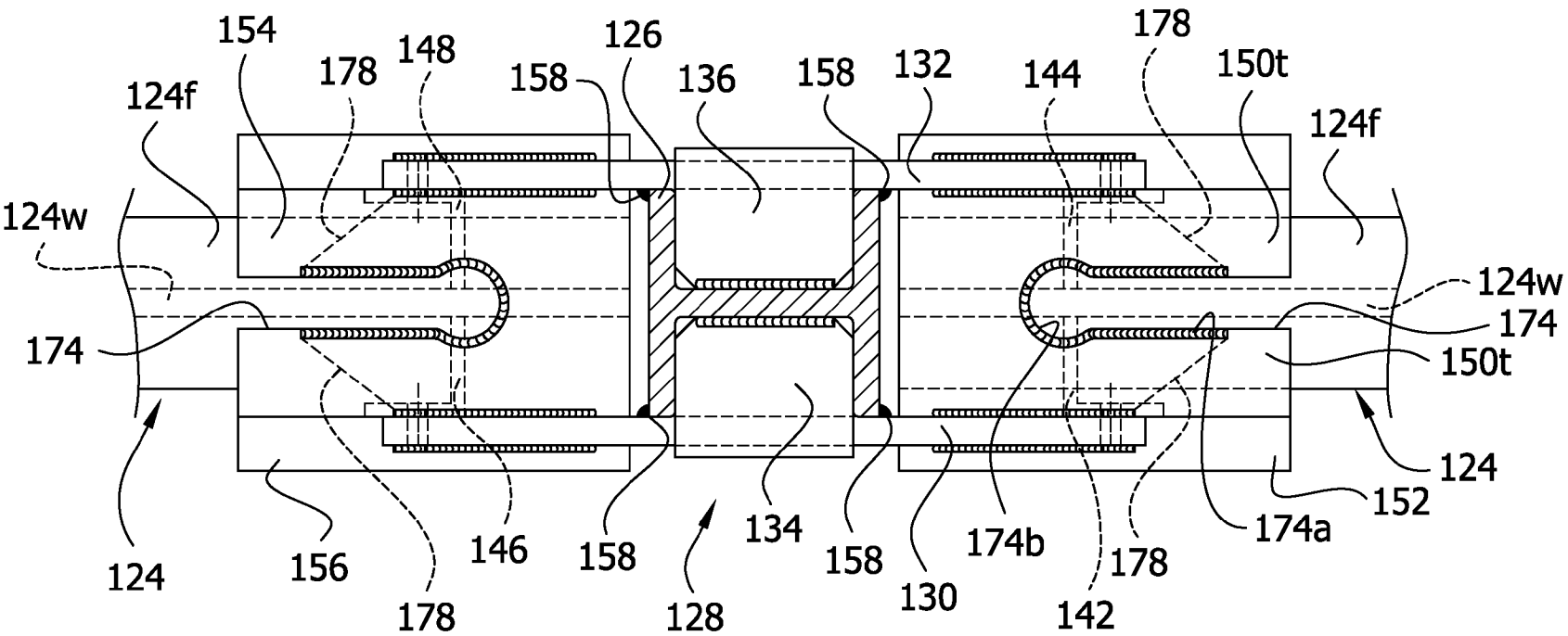
Figure 7B:
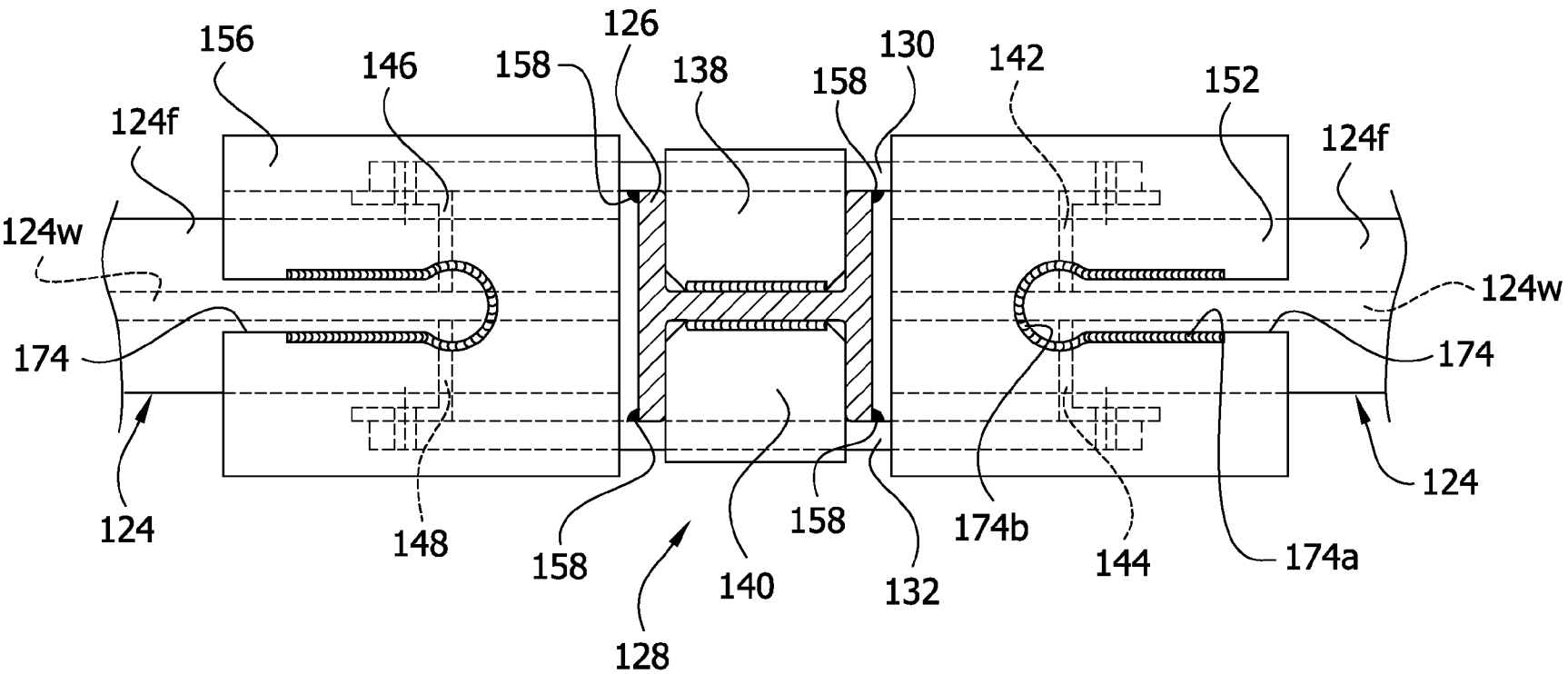
Figure 8:
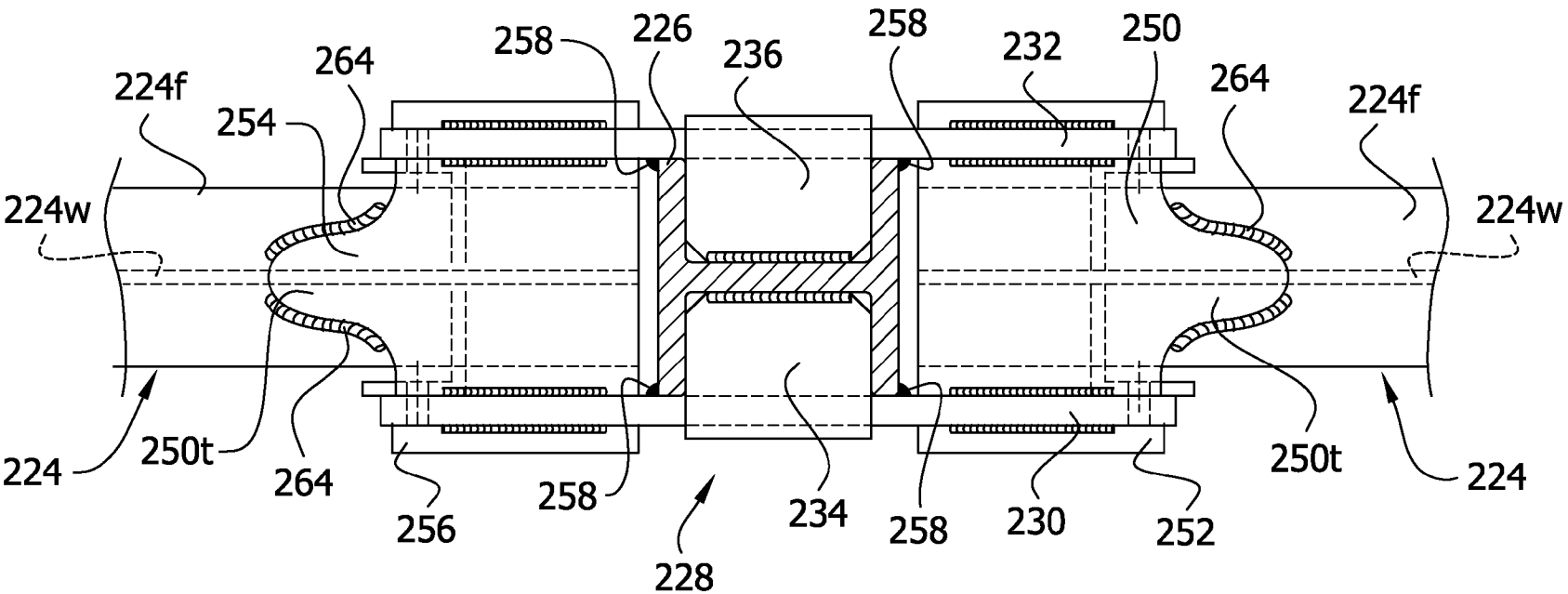
Figure 9A:
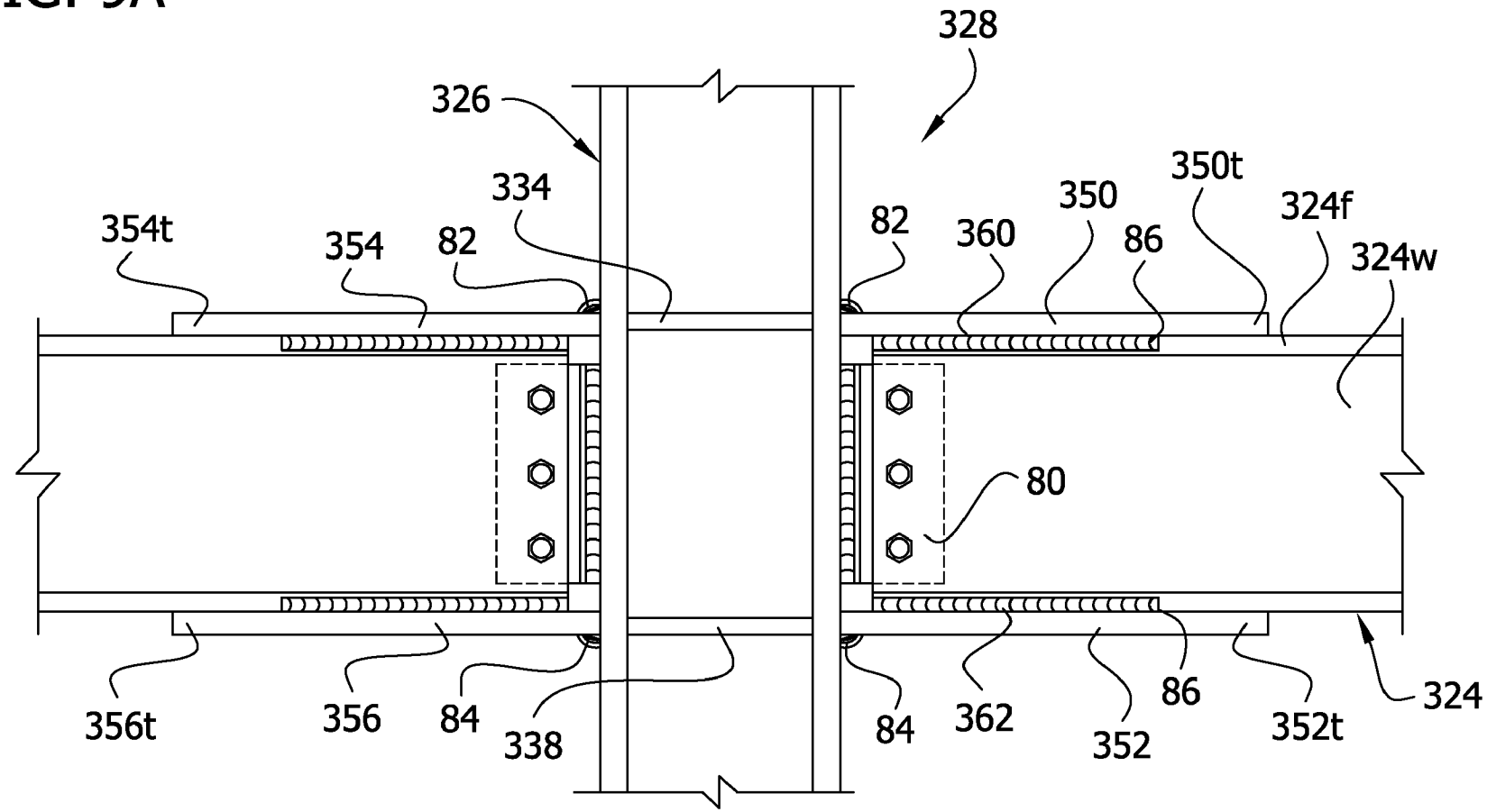
Figure 9B:
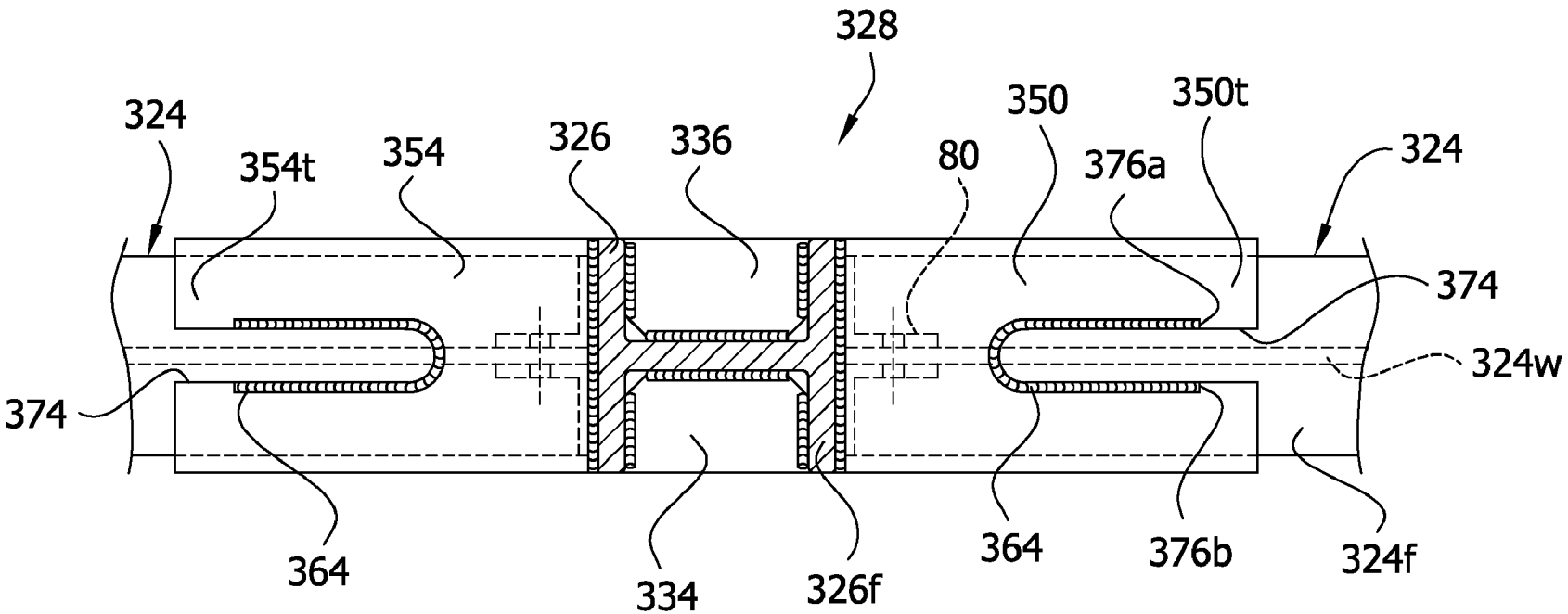

FIGS. 4A, 4B and 4C, respectively, are a top plan view, an underside view and a right end view of the beam-to-column joint connection structure seen in FIGS. 2 and 3;

FIG. 5A is a bar chart comparing the energy absorption of a tested beam in a joint connection structure according to the very best of the conventional technology, to an identical tested beam in a joint connection structure embodying this invention;

FIG. 5B similarly provides a graphical comparison of total energy dissipated during repetitive rotational cyclic straining of a tested beam in a joint connection structure according to the very best of the conventional technology, to an identical tested beam in a joint connection structure embodying this invention, and showing an improvement of 150% in total energy dissipation;

FIGS. 6A and 6B provide a diagrammatic illustrations similar to that of FIGS. 3, and 4A, but showing a portion of the beam-to-column joint connection structure of FIGS. 2 through 4B following the testing indicated in FIGS. 5A and 5B, and FIG. 6B is shown at an enlarged size compared to that of FIG. 4A in order to better show details of the structure following plastic deformation resulting from two joint connection structure rotational excursions of 6% radians rotation followed by a rotation at 7% radians;

FIGS. 7A and 7B, respectively provide a top plan view, and an underside view similar to FIGS. 4A and 4B, of an alternative embodiment of beam-to-column joint connection structure according to this invention;

FIG. 8 is a top plan view of another alternative embodiment of beam-to-column joint connection structure according to this invention; and FIGS. 9A and 9B, respectively, provide a side elevation view and a top plan view of yet another alternative embodiment of beam-to-column joint connection structure according to this invention.

Corresponding reference characters indicate corresponding parts throughout the several views of the drawings.

DETAILED DESCRIPTION

Figure 1A:
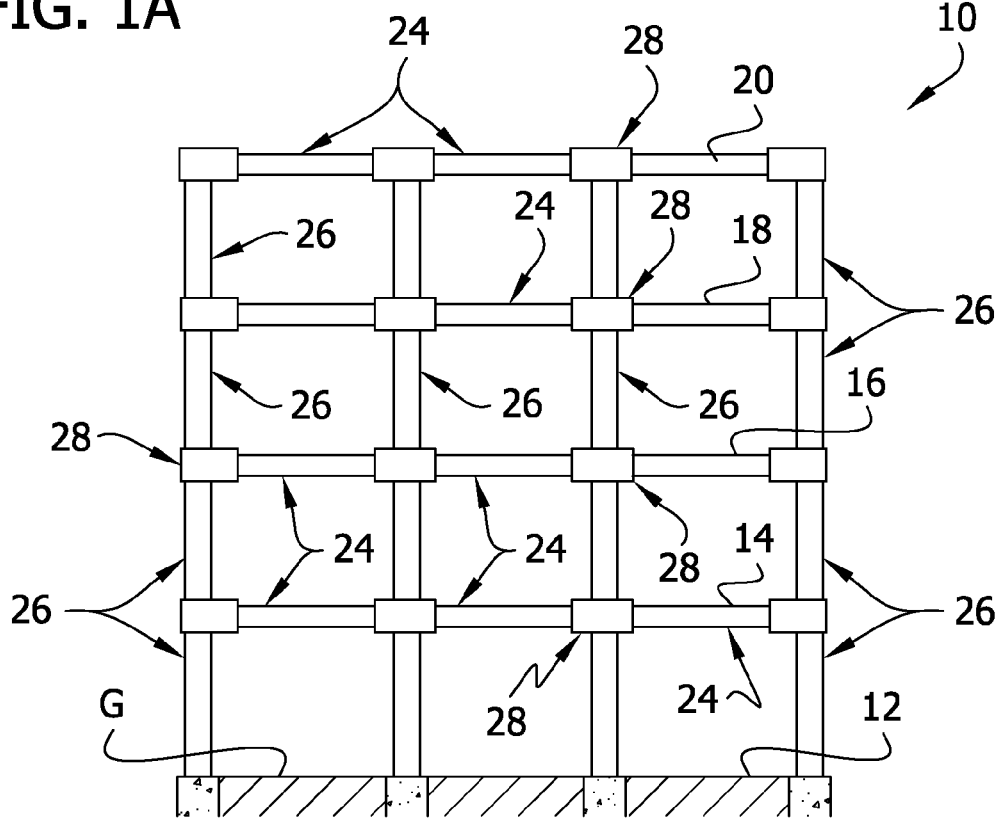

In broad overview, FIG. 1A provides a fragmentary diagrammatic elevation view of a framework 10 for a building. It will be understood by those ordinarily skilled in the pertinent arts that the framework 10 is three dimensional, although the elevation view does not illustrate this fact. In this instance, the framework 10 provides for a number of elevated floors and roof, indicated 14, 16, 18, and 20, each supported by generally horizontal beams. The beams are each generally indicated with the numeral 24. In order for the beams 24 to support the floors 14-18 and the roof 20, the building framework 10 includes plural spaced apart substantially vertical column assemblies, respectively and generally indicated with the numerals 26, each embedded into or supported upon a foundation (not seen in the drawing Figures but indicated as a ground plane "G" at which the ground floor 12 is located). It will be understood by those ordinarily skilled in the pertinent arts that the foundation may not be at grade level, but may be located at a basement (or sub-basement) of the building 10. The columns 26 join with and support the beams 24 via joint connection structures generally indicated with numeral 28. The joint connection structures 28 may be of beam-to-column type, or of beam-to-column-to-beam type, as will be further explained, dependent upon whether the joint connection structure is located along an exterior frame line of a building's framework, or along an interior frame line within the building's framework 10. Both types of joint connection structure 28 embody the present invention.

During quiet repose of the building structure, as seen in FIG. 1A, the columns 26 are substantially vertical, and the beams 24 are substantially horizontal. In greater detail, it is to be understood that the beams 24 extending between adjacent column assemblies, and during erection of the building structure 10 are welded or otherwise connected with and to the column assemblies to form an integral unitary structure. Again, as FIG. 1A illustrates, during quite repose of the building framework or structure 10, the columns 26 are substantially vertical, and the beams 24 are substantially horizontal, so that these columns and beams intersect and join to one another at 90° angulation (i.e., orthogonal, or mutually perpendicular to each other).

Figure 1B:
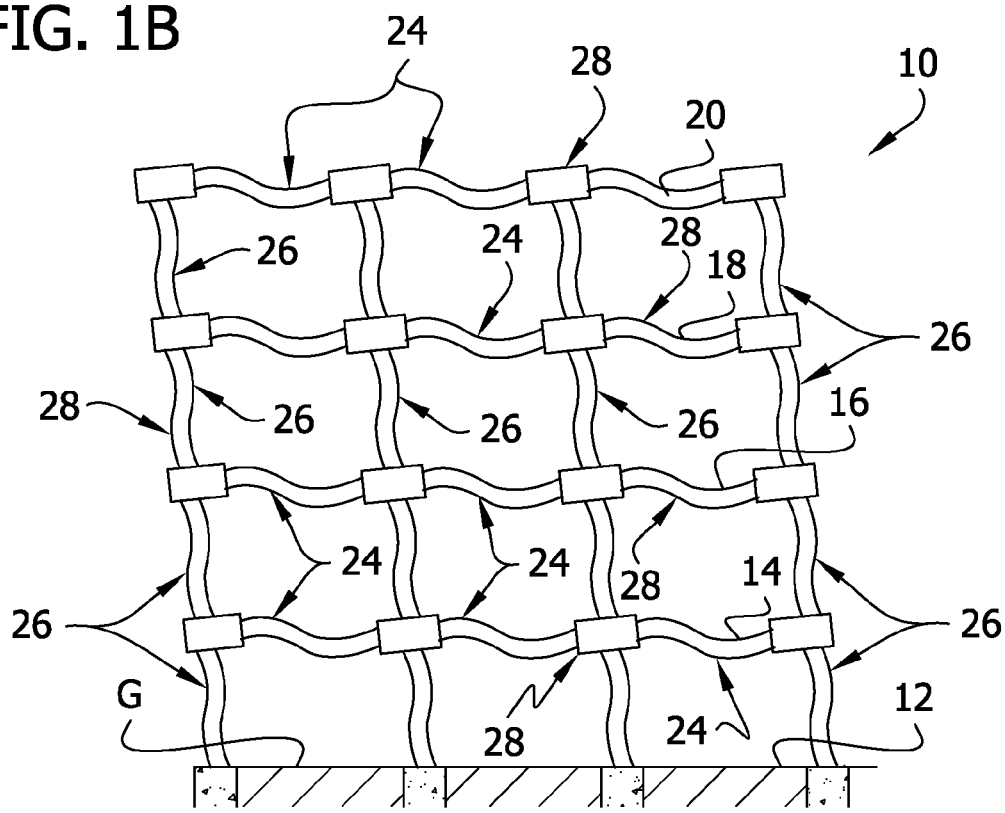

However, FIG. 1B illustrates that during a seismic event, for example, the earth (i.e., the ground plane) and foundation of the building framework 10 may shift laterally by a significant distance. Because of its great weight and inertia, the entire building 10 (i.e., the framework and all gravity load that is carried by this framework) lags behind this lateral ground shift. As a result, the building is moved laterally in cyclic motion, being laterally distorted or strained, generally as is indicated in FIG. 1B. Viewing FIG. 1B, it is easily seen that the beams 24 and columns 26 no longer remain horizontal and vertical, respectively, but remain joined by their respective beam-to-column joint connection structures while retaining a nearly orthogonal orientation to each other within these joint connection structures. In other words, both the beams 24 and their connections with the columns 26 are now somewhat rotated about their common beam-to-column joint connection structures (i.e., bent). So clearly, the global building framework 10 must be able to flex and move laterally and between story levels (i.e., referred to herein as inter-story drift), as indicated in FIG. 1B. In order for the building to remain structurally stable, and to provide for human safety, this flexing must be sustained so that even if the building is damaged beyond future use, it does not collapse. Those ordinarily skilled in the pertinent arts will understand that while some of the rotational straining experienced by the building structure during extreme loading circumstances is elastic straining, much of the rotational straining is inelastic (or plastic) straining. Accordingly, the ability of the building structure to absorb, distribute, and dissipate energy from a severe earthquake event, and survive such plastic straining determines whether the building will survive the extreme event while preserving human safety. That is, distribution and magnitude of plastic straining indicates the ability of the building structure to absorb and dissipate energy from the extreme earthquake event. A similar analysis applies when a building is subjected to explosive blast and post-blast progressive collapse load conditions, to extreme fire damage from an intense and sustained internal fire as happened at the World Trade Center buildings in New York City, and/or to massive impact and associated violent removal or demise of columns. It will be noted that the lateral distortion of the building framework is exaggerated in FIG. 1B for purposes of illustration. It is also to be understood that while a building structure may have to be demolished following an extreme event, the paramount design objective is the preservation of human life and safety.

Viewing now FIGS. 2 and 3 in conjunction, a beam-to-column-to-beam joint connection structure 28 is illustrated. For convenience, the combined beam-to-column and beam-to-beam type of joint connection structure is referred to herein as a beam-to-column-to-beam joint connection. On the other hand, a joint connection structure may be of the beam-to-column type still within the ambit of this invention. In other words, the principles of this invention apply equally to both types of joint connection structure. Further, the particular embodiment of joint connection structure illustrated allows for off-site fabrication of both column assemblies and full-length beam assemblies, followed by on-site welding (or other means of attachment) assembly of these components to result in the joint connection structures shown. For details on how the column assemblies and full-length beam assemblies are fabricated off-site and how they are united by welding or by other means in a particularly efficient and cost-effective manner at a construction site, the reader should refer to the disclosures of the patent applications referenced above (which are incorporated by reference herein). The beam assemblies are substantially similar at both of their ends, but may be different within the scope of the present invention.

Considering FIGS. 2 and 3, it is seen that the joint connection structure 28 joins two beams 24 together, and to column 26. Although the invention is not so limited, the beams 24 are of I-beam or H-beam configuration, as is the column 26. In other words, any of the beams 24, or column 26 (or other beams or columns of the building 10) could be of a different configuration or cross-sectional shape. For example, any of the elements 24, 26 (or other elements) may be made of structural square or rectangular cold-formed tube shapes (known in the industry as HSS sections), or built-up box section shapes, or of another type or configuration of structural shape.

As is seen in FIGS. 2 and 3, the joint connection structure 28 includes (in summary and in addition to a column 26 and a beam 24):

- a spaced apart parallel pair of vertically and horizontally extending gusset plates or side plates 30, 32 on the one hand sandwiching between them the column 26, and on the other hand each having oppositely extending end portions sandwiching end parts or portions of the respective beams 24 therebetween;
- four horizontal shear plates 34, 36, 38, and 40 are arranged in vertically (and horizontally) spaced pairs generally aligned at the top and bottom edges of the gusset plates (only the upper and lower ones of these shear plates are seen in FIG. 2, while the two upper shear plates 34 and 36 are seen in FIG. 4A and the two lower shear plates 38, 40 are seen in FIG. 4B);
- four vertical shear plates (or brackets) 42, 44, 46, and 48 arranged in aligned pairs at opposite ends of the gusset plates 30, 32 (only two of which are seen in FIG. 2) and connecting with the web of the beams 24. The shear brackets may be L-shaped in vertical plan view to facilitate bolted assembly during erection of the building framework; and
- four horizontal cover plates 50, 52, and 54, 56 arranged in vertically spaced pairs sandwiching a respective one of the beams 24, and connecting the gusset plates 30, 32. The cover plates 50-56 are arranged in pairs of upper and lower cover plates, with the lower cover plates being wider than the beam 24 and gusset plate spacing, and being welded to the flange tips of beam 24 and the lower outer horizontal edge of gusset plates 30, 32; and the upper cover plates being narrow enough to fit between and be welded to beam 24 and interior faces of gusset plates 30, 32.

It will be understood that the joint connection structure 28 outlined immediately above is a beam-to-column-to-beam type. A beam-to-column type of joint connection structure 28 will have fewer (but analogous) components. Because of limitations of illustration, not all of these components are seen fully in FIGS. 3 and 4A, and 4B, but the positions of the various components are indicated with arrowed numerals. Most preferably, each of the components of the joint connection structure 28, as well as the beams 24 and columns 26, are made of structural steel. Also, referring to the inventive disclosures incorporated herein by reference, it is seen that a good part of the structure depicted and described to this point is within the scope of those disclosures. Accordingly, it will be understood that the components of the joint connection structure 28 are preferably united by welding (with some of the welding initially being performed at a fabrication shop, and with the finishing welds being performed later by field welding at a building construction site). The welds join the parts of the joint 28 (as further described below) into a unitary whole, having great structural strength. In the drawing Figures, the welds preferably done at the shop are indicated with the reference numerals 58-69, and include vertically extending welds 58 which unite the interior faces of gusset plates 30, 32 with the flange tips of the column 26. A pair of horizontally extending welds 60 (FIG. 4C) unites the top cover plate 50 with the top flange of beam 24. Similarly, a pair of horizontally extending welds 62 (FIG. 4C) unites the bottom cover plate 52 with the bottom flange of the beam 24. Also, respective welds 64 and 66 (to be further described) additionally unite the top and bottom cover plates 50 and 52 with the top and bottom flanges of the beam 24. Additional welds (e.g., welds 67) are applied in the shop to unite the horizontal shear plates 34-40 with the column 26 and gusset plates 30, 32. Similarly, additional shop welds 69 unite the vertical shear plates 42-48 with the web of the beams 24.

At the construction site, beam 24 is lifted from below into position between a pair of spaced apart columns, and between the extending gusset plates 30, 32 at each column. This brings the vertical shear brackets 42-48 into alignment with the holes of the gusset plates 30, 32, and allows placement of bolts 68 to support the beam 24. Once so supported and bolted into position to closely dispose the bottom cover plate 52 against the bottom edges of the gusset plates 30, 32, field welds 70 and 72 (i.e., applied at the construction site) respectively unite the top 50 and bottom 52 cover plates with the upper extent and with the lower extent (respectively) of the side plates 30, 32. It is seen viewing FIG. 3 (and is fully explained in the referenced applications) that the field welds 70 and 72 are applied in an advantageous horizontal orientation which allows their performance in the field with great speed and ease. Those ordinarily skilled in the pertinent arts will recognize that welds depicted and described are most preferably multi-pass welds, producing a weld joint including multiple weld beads.

Further viewing FIG. 3, and giving especially now attention to FIGS. 4A and 4B, it is seen that the joint connection structures 28, and particularly the cover plates 50-56 differ in configuration from those described previously in the referenced disclosures. That is, each of the cover plates 50-56 most preferably define an elongate recess or slot, generally indicated with the numeral 74, and is joined both to its underlying or adjacent beam flange and to the adjacent gusset plates 30, 32 by a configuration of weld joint or weld beads which have already been partially described. It is to be noted that the combination of the unique configuration of the cover plates 50-56, and of their respective offset and overlapping lengths of welds 60, 64 and 62, 66 that join with the top and bottom flanges of the beams 24, respectively, and welds 70, 72 that join the gusset plates 30, 32 have been found to result in a remarkable and surprising improvement in the rotational performance and extension of the fatigue life of beam 24, and hence a corresponding enhancement to the rotational performance of its beam-to-column joint connection structural 28 which embodies this invention. The lateral offset of all the welds 60, 62, 70 and 64, 66, 72 is best seen in FIG. 4C, and the longitudinal offsets of the ends of the welds 60, 64 and 62, 66 are best seen in FIGS. 4A and 4B. The enhancement of rotational performance is especially evident when the building 10 (and its joint connections 28) are subjected to extreme cyclic tests of structural strength and durability (which may be tested or simulated as explained below), such as may happen during a severe earthquake, or because of explosion or massive impact, as is further explained below.

Turning to FIG. 4A, and taking cover plate 50 as an example because the structure and principles embodied by this cover plate apply to all four cover plates 50-56, it is seen that the cover plate 50 defines an open-ended recess or slot 74 extending along a substantial portion of the length of this cover plate, and in general alignment along the center of this slot with the web 24*w* of beam 24. The slot 74 divides the distal end of cover plate 50 into a pair of extending tongue portions 50*t*. Importantly, the cover plate 50 includes the weld 64 within the slot 74 to the top flange 24*f* of beam 24. The weld 64 does not extend over the entire length of the slot 74. The weld 64 extends from a point 76*a* spaced from the distal end of cover plate 50 along one side of the slot 74, continues around the curved bottom of this open-ended slot, and along the other side of slot 74 to a point 76*b* opposite to point 76*a*. The weld may be discontinuous and/or have other configurations within the scope of the present invention. In the illustrated embodiment, points 76*a* and 76*b* are spaced along the length direction of beam 24 both from the distal end of cover plate 50 and from the distal ends of the gusset plates 30, 32. As a result, a line 78 of initial straining of cover plate tongues 50*t* (and of the flange 24*f* of beam 24, as well as the proximate portion or volume of the web 24*w* of beam 24) extends angularly across a diagonal between the points 76*a*, 76*b*, and the respective distal ends of gusset plates 30, 32.

The joint connection structure 28 embodying this invention allows beam 24 to greatly out-performs an identical beam (i.e., even if cut from the same length of beam stock) configured with the very best of conventional beam-to-column joint connection structure technology, when subjected to loading urging rotation of the beam such as in a severe earthquake or other extreme event. Consideration of FIGS. 5A and 5B illuminates the striking differences in actual tested cyclic rotational performance of a beam 24 (i.e., Test 1 versus Test 2). These performance differences for identical sections of beam cut from a single section of beam stock are believed to be due to a more controlled starting and time-history of out-of-plane buckling of the web 24*w* of the beam 24 and lateral torsional buckling of the beam flange 24*f*, to controlled plasticity of the plate and weld components of the joint connection structure 28, to a much smoother distribution of strain into the beam 24, made possible by the unique flexibility and demonstrated plasticity of cover plate tongues 50*t*, along with planned and controlled weld tearing of sacrificial portions of weld 64.

FIGS. 6A and 6B illustrate the actual physical result of this extreme test to the durability, ductility, and stain distribution capability of a joint connection structure embodying this invention. For purposes of testing this invention and validating its performance, the size and material specification of beam 24 was intentionally selected to maximize the challenge of its rotational performance. The steel industry's newer but relatively untested 40-inch deep, highly stiff and compact, heavy hot-rolled 'H' shape structural members present new and formidable cyclic rotational challenges to engineers and researchers for the seismic pre-qualification of joint connection technologies. Despite these challenges, the beam 24 selected for testing at Lehigh University, ATLSS Engineering Research Center, Bethlehem, Pa., was 40 inches deep, weighing 294 lb/ft (designated in the industry as a "W40×294" rolled shape steel member), having a very low flange width-to-flange thickness ratio of about 3.11 (referred to in the design industry as $b_f/2t_f$) with a yield strength ($F_y$) of 50,000 psi.

The tested beam 24, configured with a joint connection structure 28 embodying this invention (i.e., Test 2) was subjected up to 7% radians of rotation, following two full cycles at 6% radians of rotation, after first resisting repetitive and progressively increasing elastic and inelastic cyclic rotations of from 1% radians to 5% radians, in accordance with national prequalification testing protocol (i.e., national design standard ANSI/AISC 341). To provide perspective to this heightened level of rotational performance of the tested very-stiff beam 24, made possible by its configuration into the joint connection structure 28 embodying this invention, the national design standard for seismic pre-qualification of steel frame beam-to-column joint connection technologies requires that a beam (such as beam 24) survive at least one full cycle of rotation at 4% radians. The tested performance of beam 24 out-performed the minimum performance threshold set by the national design standard by a ratio of 5:1 in absorbed cyclic rotational energy, thereby significantly extending the fatigue life of beam 24, even for this very stiff and challenging beam size, as validated by achieving up to 7% radians of rotation. In contrast, prior industry-test performance records for beam sizes which are much less stiff and compact than the tested beam 24 configured with the joint connection structure 28 embodying this invention, suggest that survival of 1½ to perhaps two cycles at 5% radians rotation is about the best that can be expected with a beam-to-column joint connection structure according to the very best of prior art conventional joint connection technologies.

As will be seen, a beam 24 configured into a joint connection structure 28 according to this invention (and a building frame work utilizing this invention) considerably out performs the prior art technologies, and will much better safeguard human life during an extreme event. Although the building itself certainly would have to be demolished following such an extreme event, human life and safety will be better protected, which is paramount. In view of the success of this inventive joint connection structure when configured with a particularly challenging beam size, the present inventive joint connection structure when configured with other and less challenging beam sizes is expected to offer similar improvements in rotational performance.

A consideration of the relative stress and straining experienced by a building structure and its beams 24 (and joint connection structures) utilizing this invention and considered during such extreme events will be illuminating. Turning again to a consideration of FIG. 5A, it is seen that during a cyclic rotational excursion of a building 10 from its condition of quiet repose (FIG. 1A) first in one direction to the configuration of FIG. 1B, back through the repose position, and then in the opposite direction by the same amount, a conventional joint connection structure experiences plastic deformation and energy absorption illustrated in this case by the height of the bar chart entries for progressively higher magnitude joint connection rotations (i.e., successive lateral inter-story drift angles). Up to about 4.5% radians of rotation, the energy absorption of the beam 24 configured with very best prior art conventional technology joint connection structure (i.e., Test 1) approximates that of the same beam 24 configured with a joint connection structure embodying the present invention (i.e., Test 2). It is to be noted that at 4.5% radians, the superior energy absorption of the present inventive joint connection structure is just beginning to manifest itself Beyond about 1½ cycles at 4.5% radians of rotation, the test beam embodying the conventional joint connection structure does not survive. However, the test beam (i.e., beam 24) configured with the joint connection structure according to this present invention continues to absorb cyclic energy; surviving past two cycles at 5% radians, then two cycles at 6% radians, and finally peaking at 7% radians. That is, the two bar chart entries for Test 2 to the right of 4.5% radians of rotation on FIG. 5A represent cyclic energy absorption (i.e., essentially plastic straining of the steel structure) beyond those which define the maximum cyclic performance thresholds of durability and fatigue life expectancy for the tested beam 24 configured with the very best prior art conventional technology. The total cyclic energy absorbed and dissipated for the test beam in Test 1,and for beam 24 for Test 2, is roughly indicated by the aggregate of their respective bar chart energy magnitude entries, which total energy for the tested beam 24 embodying the present inventive joint connection structure 28 is very significantly more than for the tested beam configured with the very best prior art conventional joint connection structure, as will be further explained by reference to FIG. 5B.

That is, by consideration of FIG. 5B and comparison of Test 1 with Test 2, it is seen that during the cyclic rotational straining of the tested beam and its conventional joint connection structure (Test 1), the strain progression and buildup over time in beam 24 (Test 2) is better distributed and avoids stress concentrations, and straining proceeds also in a manner which progressively (i.e., changing in a planned and controlled way with each cycle of progressively higher rotations and straining) distributes applied stain over a much larger volume of the steel of beam 24 than would be the case with a beam configured with the very best of prior art conventional technologies. FIG. 5B illustrates the total cyclic energy dissipated (i.e., absorbed) for both Test 1 and Test 2, plotted in two-cycle bands of a given threshold of joint connection rotation, in % radians (e.g., two full cycles at 4.5% radians, followed by two full cycles at 5.0% radians, etc.) in stepped-time loading increments. FIG. 5B compares the cumulative total energy and retained strain of the tested beam configured with the very best prior art conventional joint connection technology (Test 1) in comparison to that of the tested beam 24 embodying the joint connection structure 28 of this invention (Test 2), with each structural frame test assembly constructed using the same size structural members (i.e., beam 24 and column 26 sizes were unchanged). As FIG. 5B shows, the tested beam using the very best prior art conventional technology of joint connection structure reached nearly 1½ cycles at 4.5% radians of rotation (which is about the highest level this prior art conventional technology can consistently survive), corresponding to a cumulative absorbed cyclic energy of about 22,000 kip-inches of energy (where 1 kip=1000 lbs). For perspective, if the tested beam using the joint connection structure according to the very best prior art conventional technology did happen to survive up to 5% radians of rotation, then it would absorb a little less than 50,000 kip-inches of energy. In contrast, the tested beam 24 embodying the joint connection structure 28 of this invention has reliably survived over 110,000 kip-inches of cyclic energy, which level of performance achievement can also be arrived at in FIG. 5A by taking the sum of all the recorded dissipated energy magnitudes for each bar chart inter-story drift threshold. This is an absorbed cyclic energy advantage for the joint connection structure 28 of the present invention of about 5:1 when relative levels of reliable performance are compared.

For the tested beam 24 configured with the joint connection structure 28 according to this invention, and subjected to repetitive and progressively increasing simulated inter-story drift angles, its remarkable rotational cyclic performance included two full cycles of rotational excursions at 5%, then two full cycles of rotational excursions at 6% radians, ultimately reaching a maximum rotation of 7% radians (Test 2). Both of these two-cycle rotational excursions are significant enough that they would cause failure of a prior art conventional joint connection structure most of the time. Yet, the tested beam 24 configured with the joint connection structure 28 according to this invention survived these very high-level plastic rotational straining excursions. Finally, upon the tested beam 24 reaching its maximum performance threshold of rotational straining at 7% radians rotation (i.e., its fatigue life being expended), the beam 24 experienced a fracture. The indication of this beam 24's fracture is seen in FIG. 5A, where the far right-hand bar indicates the magnitude of cyclic energy absorbed during this final rotational excursion. But, it will be noted that the tested beam 24 did not fracture entirely through, leaving a non-fractured portion of the tested beam 24 that was more than sufficient to sustain and carry typical gravity loads in a typical steel frame building 10, and that further, the tongues 52*t* of lower cover plate 52 disposed below the end portion of the tested beam 24 provided an additional margin of safety because they alone are also sufficient to carry gravity loads for a building 10. Importantly, it is to be noted that the tested prior art conventional joint connection structure and the tested inventive joint connection structure 28, as tested with beam 24, included substantially the same amount of steel (i.e., tested beam 24 and column 26 were identical in size and material specification; plate and weld materials were identical in material specification and substantially the same in weight). Yet the tested beam 24 configured with the inventive joint connection structure 28 endured much greater straining, absorbed much more cyclic rotational energy, hence provided a significantly longer fatigue life than the same tested beam 24 configured with the very best of prior art joint connection structure.

Again, and re-stating the above in a different way, FIG. 5A is a bar chart comparing the energy absorption capacity of an actual tested beam of challenging size in a joint connection structure embodying the very best of conventional technologies (Test 1) to the same size beam in a joint connection structure embodying the present invention (Test 2), and in which both are subjected to repetitive and progressively increasing simulated inter-story drift angles (measured in % radians of joint connection rotation) with the associated rotational cyclic straining imposed on the beam. Again, the tested beams are actually sections cut from the very same beam stock, each identical in size and material specification, and then used in both Test 1 and in Test 2, and are also subjected to the identical testing protocol. But, the cyclic rotational performance of a joint connection structure 28 configured with a beam-to-column joint connection structure embodying this invention (Test 2), is compared to that of a joint connection structure according to the very best of conventional technologies (Test 1). These tests show a significant increase in the level of rotational performance of the inventive joint connection structure 28 over that of the joint connection structure embodying the very best of the conventional technologies. Moreover, the joint connection structure of Test 1 reached 1½ cycles at 4.5% radians compared to Test 2 reaching two full cycles at 4.5% radians, followed by two full cycles at 5.0%, followed by two full cycles at 6.0%, and ultimately reaching 7% radians of rotation. Hence, the present inventive joint connection structure demonstrated a greatly enhanced life expectancy of the tested beam configured with a beam-to-column joint connection structure embodying this invention.

FIG. 5B similarly provides a graphical comparison between the cyclic performance results of Test 1 and Test 2, showing the total cumulative energy absorption capacity of the actual tested beam sections of the same challenging size and stiffness (measured in kip-inches) subjected to repetitive and progressively increasing simulated inter-story drift angles (measured in bands of a given threshold of joint connection rotation, in % radians (e.g., two full cycles at 4.5% radians, followed by two full cycles at 5.0% radians, etc.) in stepped-time loading increments, following an identical testing load protocol. The present inventive joint connection structure (Test 2) demonstrated a 2.5:1 increase in the rotational energy absorbed by its tested beam section when configured to that of a joint connection structure according to the best of prior art (Test 1). Further; Test 2 reached a rotation of more than 7% radians after completing two full cycles at 6%, compared to Test 1 completing only 1½ cycles at 4.5% radians. The cyclic performance of the present inventive joint connection structure 28 even demonstrated a 5:1 increase in the rotational energy absorbed by the tested beam section (Test 2) compared to that which is required by the national seismic pre-qualification rotational standard (i.e., a minimum pre-qualification threshold of one full cycle at 4% radians of rotation). Hence, an exponentially enhanced life expectancy of a beam 24 and its joint connection structure over that required by the national standard (i.e., ANSI/AISC 341) is demonstrated for the tested beam when configured with the joint connection structure embodied in this invention;

That is, by consideration of FIG. 5B it is seen that during the cyclic rotational straining of the joint connection structure 28, strain is delivered into the beam 24 in a manner which avoids stress concentrations, and also in a manner which progressively (i.e., changing in a planned and controlled way with each cycle of rotational straining) distributes applied stain over a much larger volume of the steel of beam 24 than would be the case with conventional prior art technologies. As FIG. 5B shows, the very best conventional technology of a joint connection structure has absorbed about 22,000 K-in of energy at 4.5% radians rotation (which is about the highest level this conventional technology consistently survives). Even if the joint connection structure according to the very best conventional technology, configured with the tested beam the same as beam section 24, did happen to survive up to 5% radians rotation, then it would be expected to absorb a little less than 50,000 Kip-inches of energy. In contrast, the joint 28 according to this invention reliably survives over 110,000 Kip-inches of energy (i.e., adding into the total energy the additional energy represented by the three bar chart sections on the right-hand side of FIG. 5A).

FIGS. 6A and 6B again provide diagrammatic illustrations similar to that of FIGS. 3, and 4A, but depict the actual plastically-deformed shape of a tested beam's end portion and its cover plates configured with the beam-to-column joint connection structure 28 embodied in this invention, following the testing indicated in FIGS. 5A and 5B (Test 2). FIG. 6B is shown at an enlarged size compared to that of FIG. 4B in order to better show details of the structure following plastic deformation resulting from the joint connection structure 28 and beam 24 being subjected to repetitive and progressively increasing simulated inter-story drift angles, culminating with two full cycles of rotational excursions of the beam at 6% radians, followed by reaching a maximum rotation of 7% radians. That is, the illustration of FIGS. 6A and 6B diagrammatically illustrates the physical reality of a tested joint connection structure 28 embodying the present invention and after being subjected to a full two cycles at 6% radians of rotation, followed by a rotation to 7% radians, as tested at Lehigh University, ATLSS Engineering Research Center, Bethlehem, Pa. To more fully appreciate this level of achieved rotational performance in a joint connection structure, the national ANSI/AISC seismic pre-qualification steel frame design requirement for a beam-to-column joint connection structure requires only one full cycle of rotation at 4% radians. As is illustrated by shading on FIG. 6A, it is seen that the web of the web 24*w* of the tested beam 24 is bowed or buckled, that the top and bottom flanges 24*f* of beam 24 are buckled torsionally and in the out-of-plane directions, and that the cover plate tongues 50*t*, 52*t* of the top and bottom cover plates 50, 52 are plastically deformed very substantially in the out-of-plane direction. All of this plastic out-of-plane buckling (i.e., cumulative inelastic straining) of tested beam 24 represents plastic deformation of the steel of the joint connection structure 28, and much more particularly, of the beam 24. Importantly, all of this plastic deformation of the beam 24 also represents energy absorption and dissipation, and therefore results in substantially more joint connection structure rotational performance. That is, energy from a seismic event, from an explosive blast impingement, and/or from a subsequent progressive collapse load condition, from a massive impact (or other event applying extreme stressing to building framework 10) has been absorbed and dissipated by distributing the buildup of plastic cyclic rotational strain over a larger volume of the steel in beam 24, and to a lesser extent in joint connection structure 28 according to this invention. And still, even after the first fracture occurs in the tested beam 24, the uncracked (i.e., un-fractured) portion of beam 24, including the inventive joint connection structure 28, persists in being able to safely carry gravity loads for the affected story level of the framework of building 10. The building 10 would still be entirely safe so far as the preservation of human life is concerned, even after its beams 24, including their respective beam-to-column joint connection structures 28 according to this invention have experienced cyclic rotations as high as 7% radians for the tested size of beam 24. With this proven high level of performance, no building collapse would have occurred when subjected to a very large earthquake, and although the building itself might have to be demolished, life safety objectives would have been satisfied.

Further to the above, viewing FIG. 6B particularly, it is seen that the weld 64 of the inventive joint connection structure 28 has served in part as a sacrificial structural element for extending the fatigue life of beam 24, and for controlling the buckling start, and its progressive time history (i.e., with successive cyclic rotational excursions of the joint connection structure) at the end portions of the beam 24. That is, initial straining of the cover plate tongues 50*t* of cover plate 50 and the flanges 24*f* of beam 24 occurs at diagonal line 78. But, with successive cycles of rotational excursions of beam 24 imposed on its joint connection structure 28, straining does not remain principally oriented along the line 78 and (as the weld 64 progressively tears) does not occur again focused at line 78. Instead, the weld 64 tears from points 76*a*, 76*b* progressing with each successive cycle of joint connection structure rotation further and further toward the column 26, until weld tearing reaches a line extending between the distal ends of the gusset plates 30, 32. This termination line for tearing of weld 64 is indicated with a dashed line 79 on FIG. 6B. With progressive tearing of the weld 64, straining in the cover plate tongues (50*t*, for example) shifts progressively toward the column 26. And, with progressive tearing of the weld 64, straining of the web 24*w* and flanges 24*f* of beam 24 also shifts progressively toward the column 26 and consequently, shifts and distributes strain into a larger volume of steel in the web 24*w* and flanges 24*f* of beam 24. The result is that the joint connection structure 28, in particular its cover plate tongues 50*t*-56*t* of cover plates 50-56, and its off-set overlapping welds 60 and 64 and 62 and 66 (see, FIG. 4C), subjects and controls the cyclic straining over a larger volume of the steel of beam 24, than would be case with any prior art conventional joint connection structure. There are essentially four longitudinally extending welds 60, 64 connecting each of the top cover plates 50, 54 to the top flanges 24*f* of the beam 24, and four longitudinally extending welds 62, 66 connecting each of the bottom cover plates 52, 56 to the bottom flange of the beam. In order to get to four welds, each longitudinal extent of welds 64 and 66 on both sides of the U-shaped welds 64, 66 are counted as separate welds. Referring to FIG. 4A and cover plate 50 therein, the two longitudinally extending segments of weld 64 are readily seen. The welds 60 and their location relative to welds 64 are best seen in FIG. 4C. It will be noted that the two welds 60 and the two longitudinal extents of welds 64 are laterally spaced apart from each other substantial (and nearly equal) distances in comparison to the overall width of the flange 24*f*. The additional welds 64 and in particular the lateral spacing of the welds 60, 64 from each other effectively distributes strain induced into the beam more evenly. This results in lowering the strains in the beam at the critical juncture of the beam flange and the joint connection structure 28, by distributing such strains over a larger volume of the steel of beam 24, than would be case with prior art conventional joint connection structures. In addition, the quite ductile and comparatively flexible nature of the cover plate tongues 50*t*-56*t* allows the free vertical movement of the flanges 24*f* of the beam 24. In giving the flanges 24*f* the ability to buckle unrestrained, stress concentrations in the beam flanges are avoided, thereby significantly extending its fatigue life, and hence its rotational performance. Together, the larger volume of strained steel in beam 24 from the sacrificial welds 64, 66, the large lateral spacing of welds 60, 64 and 62, 66, and comparatively flexible nature of cover plate tongues 50*t*-56*t* directly equates to a much larger energy absorption and dissipation capability in beam 24 than is accomplished by an otherwise identical beam configured with conventional joint connection structure, as has been explained hereinabove in reference to FIGS. 5A and 5B.

Turning now to FIGS. 7A and 7B, an alternative embodiment of joint structure according to the present invention is illustrated. Because the embodiment of FIG. 7 shares many features with the first embodiment illustrated in FIGS. 1-6 and described above, features which are the same, or which are analogous in structure or function to those already illustrated and described are referenced on FIG. 7 with the same reference numeral used above, and increased by one-hundred (100). Viewing FIGS. 7A and 7B, it is seen that the joint structure 128 includes cover plates 150-156 each defining an elongate recess or slot, generally indicated with the numeral 174. However, in this case, the slot 174 is configured like a "keyhole" slot, with a comparatively narrow portion 174*a*, leading to an enlarged circular portion 174*b*. Again, the cover plates 150-156 are each joined both to its underlying or adjacent beam flange 124*f* and to the adjacent gusset plates 130, 132 by a configuration of weld joint or weld beads which has already been described by reference to the first embodiment. It is to be noted that the combination of the unique configuration of the cover plates 150-156, and of their joining (i.e., welding) to the top and bottom flanges 124*f* of the beams 124, and to the gusset plates 130, 132 has been found to result in a remarkable and surprising improvement in the structural performance of the joint connection structure 128. Again, taking cover plate 150 as an example, it is seen that this cover plate 150 defines a recess or slot 174 extending along a substantial portion of the length of this cover plate, and in general alignment along the center of this slot with the web 24*w* of beam 24.

The slot 174 divides the distal end of cover plate 150 into a pair of extending tongue portions 150*t*, which may be narrower or wider than tongues 50*t*, depending upon the particulars of the joint connection structure 128. As before, the cover plate 150 is welded within the slot 174 to the top flange 124*f* of beam 124 by a weld 164, but not over the entire length of the slot 174. The weld 164 extends from a point 176*a* spaced from the distal end of cover plate 150 along one side of the slot 174, around the curved and enlarged circular portion 174*b*, and continues along the other side of slot 174 to a point 176*b* opposite to point 176*a*. The points 176*a* and 176*b* are spaced along the length direction of beam 124 both from the distal end of cover plate 150 and from the distal ends of the gusset plates 130, 132. Again as a result, diagonal lines 178 of initial straining of cover plate tongues 150*t* extend angularly between the points 176 and the distal ends of gusset plates 130, 132. The joint connection structure 128 functions like that of structure 28 described above, with the cover plate tongue portions 150*t* having either greater or lesser bending stiffness, and with the enlarged portion 174*b* of the slot 174 serving to make the proximal portion of the cover plate 150 locally more flexible. Again, the particulars of the building structure 10 and its beams 24 which are to utilize the joint connection structure 128 seen in FIGS. 7A and 7B will determine the dimensions of the components for this improved joint connection structure. It will be appreciated that many different configurations of the slots are possible within the scope of the present invention.

FIG. 8 illustrates yet another alternative embodiment of joint structure according to the present invention. Because this embodiment of FIG. 8 shares many features with the first and second embodiments illustrated and described earlier, features which are the same, or which are analogous in structure or function to those already illustrated and described are referenced on FIG. 8 with the same reference numeral used above, and increased by two-hundred (200) over the first citation of the particular reference number. Viewing FIG. 8, it is seen that the joint structure 228 includes a cover plate 250 defining an elongate, single, centrally located cover plate tongue portion 250*t*. This tongue portion 250*t* aligned with the web 224*w* of the associated beam 224. The cover plate 250 is joined by welding both to its underlying or adjacent flange 224*f* of beam 224 and to the adjacent gusset plates 230, 232 by a configuration of weld joint or weld beads which has already been described by reference to the first two embodiments. The beam 224 will have a similar (but wider) lower cover plate also, as has been noted with respect to the first two embodiments. This lower cover plate may, but need not, replicate the configuration of the top cover plate 250 so far as including a single tongue portion is concerned. That is again, in contrast to the first two embodiments in which the cover plates define a pair of spaced apart, axially protruding and flexible cover plate tongue portions (i.e., 50*t*, and 150*t*, for example), the cover plate 250 of the present embodiment of FIG. 8 defines a single centrally located (i.e., aligned with the web 224*w* of beam 224) cover plate tongue portion 250*t*. This tongue portion 250*t* extends axially of the beam 224 beyond the ends of the gusset plates 230, 232, so that it is comparatively flexible, but can transfer strain from the beam 224 to its joint connection structure 228 in a desired way. In order to control the transfer of strain from the beam 224 to the gusset plates 230, 232, it is noted that a weld 264 extends along a portion of each side of this tongue 250*t*, uniting it to the adjacent flange of the beam 224. This weld 264 may, but as illustrated does not, extend about the end of tongue portion 250*t*. Moreover, by selection of the length, end curvature profile, and width of cover plate tongue 250*t*, as well as the extent of weld 264 joining this tongue to the beam 224, the progressive extent of the straining of the adjacent portion of beam 224 during progressive rotational cycles can be controlled, much as described above.

Finally, FIGS. 9A and 9B illustrate a beam-to-column joint connection construction 328 which has some features in common with the embodiments disclosed above. Accordingly, in FIGS. 9A and 9B, features which are the same, or which are analogous in structure or function to those already illustrated and described, are referenced on FIGS. 9A and 9B with the same reference numeral used above, and increased by three-hundred (300) over the first citation of the particular reference number. Viewing FIGS. 9A and 9B, it is seen that the joint structure 328 includes a pair of shear plates or shear tabs 80 which are preferably welded to the flanges 326*f* of column 326 (i.e., as shop welds). During building erection, the beam 324 is fitted against the column 326, and bolting is provided to hold the respective end of beam 324 in place. Viewing beam 324, it is seen that this beam is provided with a pair of vertically spaced apart and lengthwise extending cover plates 350, 352. These cover plates 350, 352 are likewise united with the top and bottom flanges of the beam 324 using shop welds (i.e., welds 360, 362). So, once the beam 324 is bolted to its respective shear tab 80, the top and bottom cover plates 350 and 352 at their proximal ends are properly positioned to be welded (i.e., by field welds 82, 84). Thus, it is seen that the cover plates 350, 352 strengthen and stiffen the joint connection structure 328 of beam 324 to column 326. But, in order to facilitate and control the improved distribution of strain and the desired portion of beam 324 to receive this strain from its joint connection structure 328, while at the same time avoiding stress concentration which could result in premature beam failure, the cover plates 350, 354 each define an elongate centrally disposed slot 374.

Further considering FIG. 9A, it is seen that the cover plates 350, 354 define an axially extending slot 374 which is centered generally on the web 324*w* of the beam 324, and at which weld 364 unites the respective cover plate to the adjacent flange 324*f* of the beam 324. Lower cover plates 352, 356 are also formed with slots as in the embodiment of FIGS. 1-6. The weld 364 has end points 376*a*, 376*b* spaced from the distal end of the cover plate. Further, welds 360, 362, define a distal end points 86 which are spaced axially from the end points 376*a* and 376*b* of the weld 364 in slot 374. By spacing the distal terminations of these welds axially, the improved distribution of strain communication from beam 324 into its inventive joint connection structure 328 is accomplished, and stress concentrations are avoided. Further, the comparative flexibility of the cover plate tongue portions 350*t*, and 352*t* is assured. Still further, during extreme rotational excursions of the joint connection structure 328, the weld 366 may tear or fracture progressively, thus distributing strain induced from beam 324 over a larger volume of steel than would otherwise apply. The plates 354, 356 are similarly configured.

In view of the inherent self-limiting cyclic performance of a typical steel frame beam when subjected to progressively higher-magnitude cyclic rotational movements, which ultimately determines a finite threshold of life expectancy for such a beam, and objective for this invention is to significantly increase and/or extend the life expectancy of a beam under cyclic load conditions. This may be accomplished by controlling the start, duration, and magnitude of lateral torsional buckling of the beam flanges, and out-of-plane buckling of the beam web, collectively creating greater energy absorption mechanisms, and thus significantly increasing the beam's inelastic rotational performance.

In view of the foregoing, it will be understood that several advantages may be achieved by the embodiments of the invention described above. The inelastic rotational performance of beams in a steel frame building structure is significantly increased over that obtainable with the very best conventional beam-to-column joint connection structure technologies, such as that represented by U.S. Pat. No. 5,660,017. There is an improvement in the distribution of strains in the connected end(s) of a steel frame beam, including certain components of its beam-to-column joint connection structure that have been shown to affect such strain distributions; which strains are experienced during rotations of the joint connection structure (i.e., as may occur during a seismic event, or during and following an explosive blast) such that such strains are distributed over a larger volume and length of the steel at the joint connection structure than has been possible with prior art technologies. A beam for use in a steel frame building which will survive larger inelastic joint rotations than any prior art, which will provide even larger margins of human safety and structural integrity for a building than is obtainable with the very best prior art beam-to-column joint connection structure technologies, such as that represented by the '017 patent is provided.

While the present invention has been illustrated and described by reference to preferred exemplary embodiments of the invention, such reference does not imply a limitation on the invention, and no such limitation is to be inferred. Rather, the invention is limited only by the sprit and scope of the appended claims giving full cognizance to equivalents in all respects.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

What is claimed is:

1. A joint connection structure comprising:

a column; and a beam supported by said column;

a pair of elongate horizontal cover plates arranged in a vertically spaced pair sandwiching therebetween and united with an end part of said beam proximate to said column, and said pair of cover plates also connecting with said column so as to transfer force and strain between said column and said beam, at least one of said pair of cover plates at a distal portion thereof spaced from said column defining a yieldable portion adapted to communicate and distribute strain over a volume of said beam; wherein said yieldable portion comprises a yieldable tongue portion projecting from the cover plate and extending distally along a length dimension of said beam;

whereby, during an extreme event effecting cyclic rotational movements of said joint connection structure the at least one of said pair of cover plates is plastically deformed progressively within said distal portion thereof with successive cycles of rotational movement, and said beam is also plastically deformed progressively in said volume thereof.

2. The joint connection structure of claim 1 wherein said yieldable portion further comprises a weld uniting at least a part of said tongue portion with a flange of said beam, the weld having a distal end that terminates at a point spaced inwardly from the distal end of said distal portion of the at least one of said pair of cover plates.

3. The joint connection structure of claim 2 wherein said weld is frangible during said extreme event, so that with successive rotational cycles said weld progressively fractures to distribute strain principally to said beam successively at locations spaced along the length dimension of said beam.

4. The joint connection structure of claim 1 wherein said yieldable portion comprises a pair of yieldable tongue portions defined by the at least one of said pair of cover plates and extending side-by-side distally along a length dimension of said beam.

5. The joint connection structure of claim 4 wherein the at least one of said pair of cover plates defines a central elongate slot extending along a length dimension of the at least one of said pair of cover plates and beam and opening on a distal end of the at least one of said pair of cover plates, and a weld uniting the at least one of said pair of cover plates with said beam, said weld extending along at least a part of a length dimension of said slot.

6. The joint connection structure of claim 5 wherein said weld defines a weld termination spaced from said distal end of the at least one of said pair of cover plates.

7. The joint connection structure of claim 5 wherein the at least one of said pair of cover plates defines an enlarged termination portion of said slot leading to a narrower portion of said slot which opens on a distal end of the at least one of said pair of cover plates, whereby said enlarged termination portion of said slot effects a concomitant narrowing of each of said pair of tongue portions.

8. The joint connection structure of claim 1 wherein both of said pair of elongate horizontal cover plates comprise a yieldable portion each including at least a respective tongue portion extending along a length dimension of said beam.

9. The joint connection structure of claim 8 further including a pair of gusset plates extending horizontally and sandwiching said column therebetween and united therewith, an end portion of said pair of gusset plates also sandwiching therebetween an end portion of said beam, said pair of cover plates also being united with said pair of gusset plates.

10. A full-length beam assembly for use in a joint connection structure, said full-length beam assembly comprising a length of I-section or H-section beam stock; and at least one end portion of said section of beam stock carrying a pair of elongate horizontal cover plates arranged in a vertically spaced pair sandwiching therebetween and united with said end portion of said beam stock, at least one of said pair of cover plates at a distal portion thereof spaced from the respective end of said length of beam stock defining a yieldable portion adapted to communicate and distribute strain to said beam over an extended length portion thereof so that during an extreme event effecting cyclic rotational movements of said joint connection structure the at least one of said pair of cover plates is plastically deformed progressively within said distal portion thereof with successive cycles of rotational movement, and said beam is also plastically deformed progressively adjacent to said distal portion of the at least one of said pair of cover plates; and said yieldable portion comprising a yieldable tongue portion defined by the at least one of said pair of cover plates and extending along a length dimension of said beam at said distal portion of the at least one of said pair of cover plates; said yieldable tongue portion projecting from the cover plate;

wherein said yieldable portion further comprises a weld uniting at least a part of said tongue portion with a flange of said beam, the weld having a distal end that terminates at a point spaced inwardly from a distal end of said distal portion of the at least one of said pair of cover plates.

11. A method of increasing the volume and length of steel at an end part of a beam throughout which plastic strain in a steel frame building is distributed, so that said beam absorbs increased strain during an extreme event, which extreme event effects plural rotational displacement cycles of joint connection structures of the building, thus preserving building integrity and human life, said method comprising steps of:

providing a column; and providing a beam supported by said column;

on said column providing a spaced apart parallel pair of vertically and horizontally extending elongate gusset plates sandwiching said column therebetween and united therewith; and providing said pair of gusset plates each with an extending end portion sandwiching an end part of said beam therebetween and united with said beam;

providing a pair of elongate horizontal cover plates arranged in a vertically spaced pair sandwiching therebetween and united with an end part of said beam, and providing for said cover plates to unite with and connect said pair of gusset plates so that said pair of cover plates form the connection between said beam and said pair of gusset plates and transfer force and strain between said column and said beam;

defining in at least one of said pair of cover plates at a distal portion thereof spaced from said column a yieldable tongue for communicating strain into said beam and for progressively distributing strain into said beam over an extended length portion thereof with successive rotational cycle and increasing straining of said beam; wherein said yieldable tongue projecting from the cover plate and extending distally along a length dimension of said beam;

whereby, during an extreme event the yieldable tongue of the at least one of said pair of cover plates is plastically deformed progressively with successive rotational cycles of said joint connection structure, and said beam is also plastically deformed progressively distal of said pair of gusset plates.

12. The method of claim 11 including the step of defining said yieldable tongue on a side of a slot extending centrally of the at least one of said pair of cover plates, and providing a weld extending along the length of said slot and terminating short of a distal end of the at least one of said pair of cover plates.

13. The method of claim 12 further including the step of providing for said weld to be frangible in a distal part thereof to increase the yieldability of said tongue by progressive fracturing of said weld from a distal end termination of said weld and toward said column.

14. The method of claim 13 further including the step of defining respective horizontal welds between said pair of gusset plates and said pair of cover plates, forming each of said horizontal welds to have a termination point which is spaced along a length dimension of said beam from the termination of said weld within the slot in the at least one of said pair of cover plates.

* * * * *